US008685611B2

(12) United States Patent
Ozawa et al.

(10) Patent No.: US 8,685,611 B2
(45) **Date of Patent: *Apr. 1, 2014**

(54) ELECTROPHOTOGRAPHIC PHOTOSENSITIVE MEMBER AND ELECTROPHOTOGRAPHIC APPARATUS

(71) Applicant: Canon Kabushiki Kaisha, Tokyo (JP)

(72) Inventors: Tomohito Ozawa, Mishima (JP); Kazuyoshi Akiyama, Mishima (JP); Yuu Nishimura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/661,363

(22) Filed: Oct. 26, 2012

(65) Prior Publication Data

US 2013/0114975 A1 May 9, 2013

Related U.S. Application Data

(62) Division of application No. 12/505,692, filed on Jul. 20, 2009, now Pat. No. 8,323,862.

(30) Foreign Application Priority Data

Jul. 25, 2008 (JP) ..... 2008-191977
Jul. 25, 2008 (JP) ..... 2008-191983
Jul. 10, 2009 (JP) ..... 2009-163656

(51) Int. Cl.
*G03G 5/147* (2006.01)

(52) U.S. Cl.
USPC ..... 430/123.42; 430/66; 430/57.4

(58) Field of Classification Search
USPC ..... 430/123.42, 66, 57.4
See application file for complete search history.

(56) References Cited

U.S. PATENT DOCUMENTS 4,555,464 A 11/1985 Kido et al.
4,559,289 A 12/1985 Sunagawa et al.
4,569,855 A 2/1986 Matsuda et al.
4,659,639 A 4/1987 Mizuno et al.
4,683,144 A 7/1987 Nishimura et al.
4,683,145 A 7/1987 Nishimura et al.
4,683,146 A 7/1987 Hirai et al.
4,683,147 A 7/1987 Eguchi et al.
4,777,103 A 10/1988 No et al.
4,795,691 A 1/1989 Takei et al.
5,112,709 A 5/1992 Yamazaki et al.
5,164,281 A 11/1992 Hayakawa et al.
5,392,098 A 2/1995 Ehara et al.
5,455,138 A 10/1995 Okamura et al.
5,480,750 A 1/1996 Kawada et al.
5,582,944 A 12/1996 Yamamura et al.
5,817,181 A 10/1998 Okamura et al.
5,849,446 A 12/1998 Hashizume et al.
5,976,745 A 11/1999 Aoki et al.
6,110,629 A 8/2000 Ehara et al.
6,122,467 A 9/2000 Ehara et al.
6,183,930 B1 2/2001 Ueda et al.
6,233,417 B1 5/2001 Nakayama et al.
6,238,832 B1 5/2001 Hashizume et al.
6,322,943 B1 11/2001 Aoki et al.
6,605,405 B2 8/2003 Owaki et al.
7,033,717 B2 * 4/2006 Kojima et al. ..... 430/66
7,157,197 B2 1/2007 Aoki et al.
7,255,969 B2 8/2007 Kojima et al.
7,498,110 B2 3/2009 Taniguchi et al.
8,323,862 B2 * 12/2012 Ozawa et al. ..... 430/66
2010/0021835 A1 1/2010 Akiyama et al.
2010/0021836 A1 1/2010 Ozawa et al.
2010/0021837 A1 1/2010 Ozawa et al.
2010/0112470 A1 5/2010 Ohira et al.
2011/0117484 A1 5/2011 Ozawa et al.
2011/0123215 A1 5/2011 Nishimura et al.
2011/0123914 A1 5/2011 Akiyama et al.
2011/0123915 A1 5/2011 Ozawa et al.
2011/0129770 A1 6/2011 Aoki et al.
2011/0129776 A1 6/2011 Akiyama et al.

FOREIGN PATENT DOCUMENTS

EP 0 220 993 A2 5/1987
EP 1 158 368 A2 11/2001
EP 1 887 427 A1 2/2008
JP 58-080656 A 5/1983
JP 05-018471 A 1/1993
JP 06-102686 A 4/1994
JP 06-250425 A 9/1994
JP 07-043921 A 2/1995
JP 07-175244 A 7/1995
JP 08-022229 A 1/1996
JP 09-297420 A 11/1997
JP 10-104911 A 4/1998
JP 11-161120 A 6/1999
JP 2000-003055 A 1/2000
JP 3124841 B2 10/2000

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

*Primary Examiner* — Christopher Rodee

(74) *Attorney, Agent, or Firm* — Fitzpatrick, Cella, Harper & Scinto

(57) ABSTRACT

In an electrophotographic photosensitive member having a photoconductive layer and, provided on the photoconductive layer, a surface layer constituted of a hydrogenated amorphous silicon carbide, the ratio of the number of atoms of carbon atoms (C) to the sum of the number of atoms of silicon atoms (Si) and number of atoms of carbon atoms (C), C/(Si+C), in the surface layer is from 0.61 or more to 0.75 or less, and the sum of atom density of the silicon atoms and atom density of the carbon atoms in the surface layer is $6.60\times10^{22}$atom/cm$^3$ or more.

6 Claims, 5 Drawing Sheets

(56) References Cited

FOREIGN PATENT DOCUMENTS

| | | | |
|---|---|---|---|
| JP | 2001-330978 | A | 11/2001 |
| JP | 2002-123020 | A | 4/2002 |
| JP | 2002-148907 | A | 5/2002 |
| JP | 2002-229303 | A | 8/2002 |
| JP | 2002-278114 | A | 9/2002 |
| JP | 2002-296281 | A | 10/2002 |
| JP | 2002-296987 | A | 10/2002 |
| JP | 2003-337437 | A | 11/2003 |
| JP | 2004-133397 | A | 4/2004 |
| JP | 2 148 245 | A | 1/2010 |

* cited by examiner

ELECTROPHOTOGRAPHIC PHOTOSENSITIVE MEMBER AND ELECTROPHOTOGRAPHIC APPARATUS

This application is a divisional of application Ser. No. 12/505,692, filed on Jul. 20, 2009.

BACKGROUND OF THE INVENTION

1. Field of the Invention

The present invention relates to an electrophotographic photosensitive member having a surface layer made up of hydrogenated amorphous silicon carbide and an electrophotographic apparatus having such an electrophotographic photosensitive member. The hydrogenated amorphous silicon carbide is hereinafter also expressed as "a-SiC". The surface layer made up of the hydrogenated amorphous silicon carbide is hereinafter also expressed as "a-SiC surface layer".

2. Description of the Related Art

Among various kinds of electrophotographic photosensitive members, an amorphous silicon electrophotographic photosensitive member is widely known which has a substrate such as a metal and formed thereon a photoconductive layer (photosensitive layer) made up of an amorphous material. The amorphous silicon electrophotographic photosensitive member is hereinafter also expressed as "a-Si photosensitive member".

As an example of the make-up of such an a-Si photosensitive member, a make-up is available in which the photoconductive layer is formed on the substrate and the a-SiC surface layer is formed on the photoconductive layer. Since the a-SiC surface layer has an excellent wear resistance, it has chiefly been used in electrophotographic apparatus having a high process speed.

However, in any conventional a-SiC surface layer, it has come about in some cases that, when used in an environment having a high absolute humidity, blurred characters or letters are formed, or characters or letters are not printed to cause blank areas in images (hereinafter such a phenomenon is also expressed as "high-humidity image flow (or image deletion due to high-humidity)").

The high-humidity image flow refers to a phenomenon of faulty images that, where images are reproduced using an electrophotographic apparatus placed in the environment having a high absolute humidity and images are again reproduced after a while, blurred characters or letters are formed, or characters or letters are not printed to cause blank areas in the images reproduced again.

The high-humidity image flow is considered to occur because the electrophotographic photosensitive member comes to have a low surface resistance upon adsorption of water on its surface to cause any electric charges thereon to flow transversely. Hence, it more tends to occur where the environment in which the electrophotographic apparatus is placed has a high absolute humidity or where a photosensitive member heater provided in the vicinity of the a-Si photosensitive member is not on use.

As a technique for keeping the high-humidity image flow from occurring, Japanese Patent No. 3124841 discloses a technique in which atom densities of various atoms making up the surface layer are set smaller than specific value and the a-SiC surface layer is formed to have a relatively coarse film structure so as to make the surface layer easily abradable in a cleaning process. Making the a-SiC surface layer easily abradable makes any charge products or water having come adsorbed on the surface removable with ease together with an oxide layer formed on the surface of the a-SiC surface layer, and hence this enables the high-humidity image flow to be kept from occurring.

In recent years, in the market, electrophotographic apparatus have made progress in high-speed and color image formation, and their process has changed into an electrophotographic process that makes the electrophotographic photosensitive member surface more tend to wear. Meanwhile, in the market, accompanied by such high-speed and color image formation, there is also a demand for an electrophotographic apparatus that enables stable reproduction of images having a high image quality. For such a commercial demand, it has come necessary to provide an electrophotographic photosensitive member improved in keeping the high-humidity image flow from occurring, while maintaining a good wear resistance.

In this regard, the employment of the technique disclosed in Japanese Patent No. 3124841 requires making the surface of the electrophotographic photosensitive member abrade at a certain speed, and hence tends to damage its durability especially in a high-speed electrophotographic process.

Stated specifically, in the technique disclosed in Japanese Patent No. 3124841, in order to remove the oxide layer formed on the surface of the electrophotographic photosensitive member or any charge products, water or the like having come adsorbed on the oxide layer (i.e., adsorbed matter), it has been necessary for the surface of the electrophotographic photosensitive member to be provided with a certain readiness to wear.

In addition, it has also come about in some cases that such a surface layer tending to wear comes to have pressure scars (or scratches) to make the lifetime of the electrophotographic photosensitive member limitative. The pressure scars refer to a phenomenon that a mechanical stress is applied to the electrophotographic photosensitive member surface to cause scratch-like image defects such as black line or white line on images. Such pressure scars tend to be conspicuous especially when halftone images are reproduced in a highly precise electrophotographic process, and are the cause of lowering image quality and also making the electrophotographic photosensitive member have a short lifetime.

That is, in conventional electrophotographic photosensitive members and electrophotographic apparatus, it has been difficult for them to be improved in keeping the high-humidity image flow from occurring, while maintaining a good wear resistance.

SUMMARY OF THE INVENTION

An object of the present invention is to provide an electrophotographic photosensitive member having superior high-humidity image flow resistance (high-humidity image flow preventive effect) and wear resistance, and an electrophotographic apparatus having such an electrophotographic photosensitive member.

The present invention is an electrophotographic photosensitive member having a photoconductive layer and, provided on the photoconductive layer, a surface layer constituted of a hydrogenated amorphous silicon carbide, wherein; the ratio of the number of atoms of carbon atoms (C) to the sum of the number of atoms of silicon atoms (Si) and number of atoms of carbon atoms (C), C/(Si+C), in the surface layer is from 0.61 or more to 0.75 or less, and the sum of atom density of the silicon atoms and atom density of the carbon atoms in the surface layer is $6.60\times10^{22}$atom/cm$^3$ or more.

According to the present invention, it can provide an electrophotographic photosensitive member having superior high-humidity image flow resistance and wear resistance, and an electrophotographic apparatus having such an electrophotographic photosensitive member.

Further features of the present invention will become apparent from the following description of exemplary embodiments with reference to the attached drawings.

DESCRIPTION OF THE PREFERRED EMBODIMENTS

The present inventors have made extensive studies in order to materialize the electrophotographic photosensitive member having superior high-humidity image flow resistance and wear resistance. As a result of the studies, they have discovered that the high-humidity image flow can roughly be grouped into the following two phenomena A and B.

A: A phenomenon that, where images are reproduced in an environment having a high absolute humidity and, after the apparatus has been left to stand overnight as it is, images are reproduced in the next morning, it comes about that images are formed with a lowering of image density in some images. This lowering of image density comes about at a region where an electrophotographic photosensitive member and a charging assembly had stood face to face during leaving of the apparatus. Such a phenomenon is hereinafter also expressed as "image flow below charger".

B: A phenomenon that, where images are reproduced in the next morning like the above, it comes about that, with occurrence of the image flow below charger, images are formed with a lowering of image density also at a region where the electrophotographic photosensitive member and the charging assembly had not stood face to face during leaving of the apparatus. This phenomenon may occur when images are reproduced in a large volume (images are continued to be reproduced over a long period of time) and occurs over the whole area of images as being different from the image flow below charger that occurs locally on images. Such a phenomenon is hereinafter also expressed as "image flow during running".

From these two phenomena, the high-humidity image flow has been found to be a composite phenomenon consisting of the image flow below charger and the image flow during running.

The present inventors have presumed as stated below the mechanism by which the above two phenomena may come about. The mechanism presumed is explained with reference to FIGS. 1A and 1B.

Figure 1A:
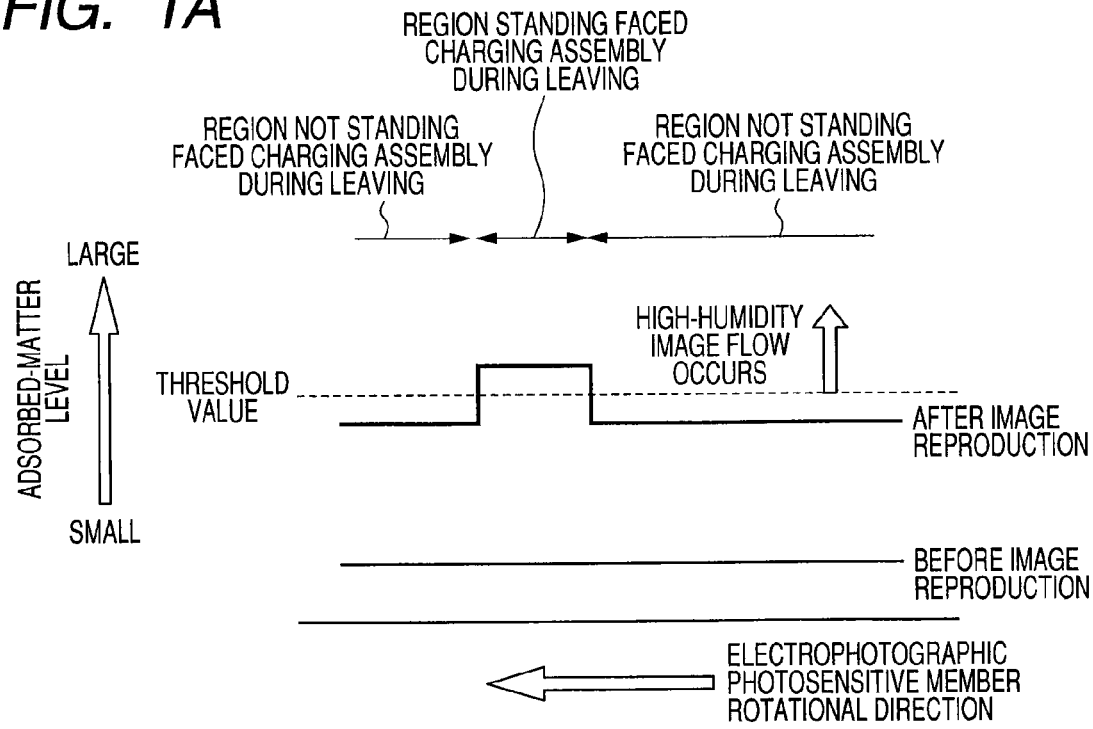
FIG. 1A is a diagrammatic illustration to explain a phenomenon of image flow below charger.

FIG. 1A is a diagrammatic illustration to explain the phenomenon A, and shows the relationship between the amount of adsorption of the adsorbed matter having come adsorbed on the surface of an electrophotographic photosensitive member and how the high-humidity image flow occurs. The high-humidity image flow comes to appear on images when the amount of adsorption of the adsorbed matter such as charge products or water exceeds a threshold value at which the high-humidity image flow may occur.

First, at the initial stage before image reproduction, the adsorbed matter on the surface of the electrophotographic photosensitive member is in a small quantity. Next, think about how the surface stands after image reproduction where images have repeatedly been reproduced. In such a state, it comes about that the surface layer of the electrophotographic photosensitive member is oxidized chiefly because of the influence of charging and polar groups are formed on the surface of the electrophotographic photosensitive member. As influences on the high-humidity image flow, of the fact that such polar groups are formed, the following two ways of action are conceivable.

In the first place, it is the action of polar groups themselves that makes the amount of adsorption of water higher to tend to cause the surface of the electrophotographic photosensitive member to be made low-resistance.

In the second place, it is the action that makes, upon formation of the polar groups, the surface of the electrophotographic photosensitive member changes into a surface on which the charge products tend to be adsorbed. It is considered that, as a result of adsorption of water, the charge products make the surface of the electrophotographic photosensitive member more acceleratedly low-resistance.

It is considered that the adsorbed matter such as charge products or water increases because of any cooperative action of these two ways of action to bring forth a situation where the high-humidity image flow tends to occur.

Next, think about a case in which in such a state the electrophotographic photosensitive member is left to stand in the interior of an electrophotographic apparatus. At a region where it stands faced the charging assembly during leaving, the charge products are present around the charging assembly in a large quantity and, in addition thereto, as a result of the oxidation the surface of the electrophotographic photosensitive member has come into a state that the charge products tend to be adsorbed thereon. Hence, it comes about that the charge products come adsorbed on the surface of the electrophotographic photosensitive member in a large quantity. As the result, the amount of adsorption of the adsorbed matter such as charge products or water exceeds the threshold value to cause the high-humidity image flow, as so considered. On the other hand, at a region where it does not stand faced the charging assembly during leaving, the surface stands highly adsorptive of the charge products or water as a result of the oxidation, but the charge products to be adsorbed thereon are present in a small quantity, and hence the amount of adsorption of the adsorbed matter does not come to exceed the threshold value.

It is presumed that the image flow during running occurs as a consequence of the foregoing.

Figure 1B:
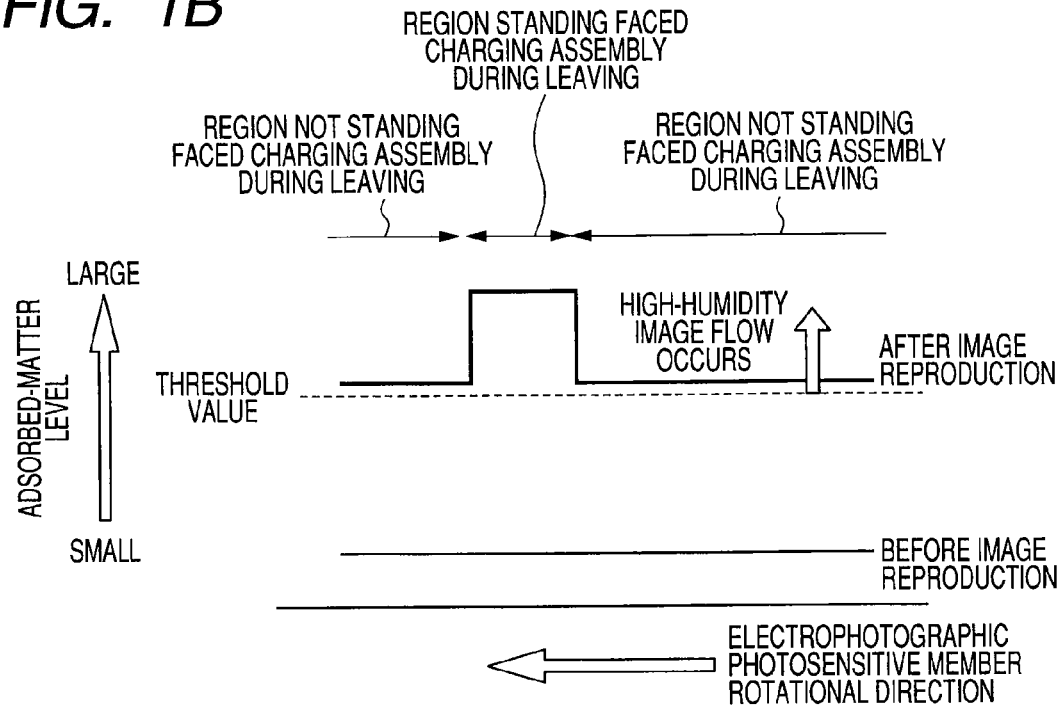
FIG. 1B is a diagrammatic illustration to explain a phenomenon of image flow during running.

FIG. 1B is a diagrammatic illustration to explain the phenomenon B, and, like FIG. 1A, shows the relationship between the amount of adsorption of the adsorbed matter having come adsorbed on the surface of an electrophotographic photosensitive member and how the high-humidity image flow occurs. What differs from FIG. 1A is that FIG. 1B shows a situation where image formation has been repeated over a longer period of time than the case shown in FIG. 1A.

Because of an influence of charging having repeatedly been performed over a long period of time, the surface of the a-SiC surface layer becomes more oxidized than the case shown in FIG. 1A, and becomes much more adsorptive of the charge products or water. Hence, it comes about that, not only at the part that faces the charging assembly during leaving, at which the charge products are present in a large quantity, but also at the part that does not stand faced the charging assembly during leaving, at which the charge products are present originally in a small quantity, the amount of adsorption of the adsorbed matter comes to exceed the threshold value chiefly because of an increase in the amount of adsorption of water. As the result, the high-humidity image flow occurs also at the region where the electrophotographic photosensitive member does not stand faced the charging assembly during leaving, as so presumed.

As above, it has come to light that there are two factors in the high-humidity image flow, which are the image flow below charger and the image flow during running. As stated above, the causes thereof can be said to be, in either case, an increase in the amount of adsorption of the charge products or water. Thus, it has turned out that, in order to keep both the image flow below charger and the image flow during running from occurring, it is very important to keep the a-SiC surface layer from its oxidation that influences the adsorptivity of the adsorbed matter.

Keeping the a-SiC surface layer from its oxidation enables control of the amount of adsorption of the charge products or water. This makes it unnecessary for the surface of the a-SiC surface layer to be made large in the depth of wear (i.e., made easily abradable) in order to remove the oxide layer and adsorbed matter from its surface, so that the electrophotographic photosensitive member can maintain its good wear resistance.

Accordingly, the present inventors have considered that keeping the a-SiC surface layer from being oxidized because of the charging enables formation of an a-SiC surface layer having superior wear resistance while lessening the adhesion of the adsorbed matter thereto than any conventional cases, and have made extensive studies. As the result, they have discovered that the ratio of the number of atoms of carbon atoms to the sum of the number of atoms of silicon atoms and number of atoms of carbon atoms, which make up the a-SiC surface layer, may be set within a specific range and, in addition thereto, the sum of atom density of the silicon atoms and atom density of the carbon atoms may be set larger than a specific value, and this is effective in resolving the problems discussed above. Thus, they have accomplished the present invention.

The electrophotographic photosensitive member of the present invention, as summarized above, has a photoconductive layer and, provided on the photoconductive layer, a surface layer constituted of a hydrogenated amorphous silicon carbide (an a-SiC surface layer), and is characterized in that; the ratio of the number of atoms of carbon atoms (C) to the sum of the number of atoms of silicon atoms (Si) and number of atoms of carbon atoms (C), C/(Si+C), in the surface layer is from 0.61 or more to 0.75 or less, and; the sum of atom density of the silicon atoms and atom density of the carbon atoms in the a-SiC surface layer is $6.60\times10^{22}$atom/cm$^3$ or more.

Here, the ratio of the number of atoms of carbon atoms to the sum of the number of atoms of silicon atoms and number of atoms of carbon atoms is hereinafter also expressed as "C/(Si+C)". The atom density of silicon atoms is hereinafter also expressed as "Si atom density". The atom density of carbon atoms is hereinafter also expressed as "C atom density". The sum of atom density of silicon atoms and atom density of carbon atoms is hereinafter also expressed as "Si+C atom density".

Surface Layer

Setting the Si+C atom density in the a-SiC surface layer at $6.60\times10^{22}$atom/cm$^3$ or more brings great improvements in high-humidity image flow resistance and wear resistance. The reason therefor is shown below.

That is, the oxidation reaction of a-SiC takes place because the bonding between silicon atoms and carbon atoms is cut upon oxidation and elimination of carbon atoms of the a-SiC and an oxidizing substance reacts with dangling bonds of silicon atoms formed newly. In this regard, according to the present invention, making large the value of Si+C atom density in the a-SiC surface layer makes it possible that the bonding between silicon atoms and carbon atoms can not easily be cut. Also, making large the value of Si+C atom density makes the a-SiC surface layer have a low void, and hence this lowers the probability of reaction of carbon atoms with the oxidizing substance. In the electrophotographic process, it is considered that the reaction of carbon atoms with ionic species formed through the step of charging causes the oxidation and elimination of the carbon atoms. Accordingly, such carbon atoms may be kept from being oxidized, whereby the silicon atoms can also be kept from being oxidized.

According to the present invention, the distance between constituent atoms themselves of the a-SiC surface layer is shortened, and the layer can have a low void, and hence the surface of the a-SiC surface layer is kept from being oxidized and any polar groups are kept from being formed on the surface of the a-SiC surface layer, as so considered. As the result, the high-humidity image flow can be kept from occurring.

In addition, the constituent atoms of the a-SiC surface layer can enjoy a high bonding force, and hence the a-SiC surface layer can have a high hardness, so that the electrophotographic photosensitive member can be improved in its wear resistance as well, as so considered.

From the foregoing viewpoint, it is preferable for the a-SiC surface layer to have a higher Si+C atom density, which is $6.81\times10^{22}$atom/cm$^3$ or more, and this makes the electrophotographic photosensitive member more improved in its high-humidity image flow resistance and wear resistance. Here, in the a-SiC, the atom density of $13.0\times10^{22}$atom/cm$^3$, which is that of SiC crystals standing most high-density, is the upper limit of the Si+C atom density.

In addition to the feature that the Si+C atom density in the a-SiC surface layer is in the above range, the C/(Si+C) in the a-SiC surface layer is from 0.61 or more to 0.75 or less. This is necessary in order to attain excellent electrophotographic photosensitive member performance.

In the a-SiC surface layer, if it has a C/(Si+C) of less than 0.61, the a-SiC may have a low resistance, especially where an a-SiC having a high atom density is produced. In such a case, carriers tend to flow transversely in the surface layer when electrostatic latent images are formed. Hence, when isolated dots are formed as electrostatic latent images, the isolated dots may come small because of such flow transversely of carriers in the surface layer. As the result, in the imaged reproduced, a low image density may inevitably come especially on the low-density side, and hence the images may come to have a low gradation. For such reasons, in the a-SiC surface layer having a high atom density as in the present invention, the C/(Si+C) must be 0.61 or more.

If on the other hand the a-SiC surface layer has a C/(Si+C) of more than 0.75, the absorption of light in that layer may abruptly increase, especially where an a-SiC having a high atom density is produced. In such a case, the amount of light of imagewise exposure light necessary when electrostatic latent images are formed may come so large as to result in an extreme lowering of sensitivity. Also, since the sensitivity may greatly vary corresponding to the depth of wear of the a-SiC surface layer, the image density may come to be non-uniform if the electrophotographic photosensitive member has come to wear non-uniformly. For such reasons, in the a-SiC surface layer having a high atom density as in the present invention, the C/(Si+C) must be 0.75 or less.

For the reasons as above, in order to improve oxidation resistance of the a-SiC surface layer to keep the high-humidity image flow from occurring while maintaining any preferable electrophotographic photosensitive member performance, the Si+C atom density in the a-SiC surface layer must be $6.60\times10^{22}$atom/cm$^3$ or more, and the C/(Si+C) in the surface layer, from 0.61 or more to 0.75 or less.

In the present invention, it is also preferable that the ratio of the number of atoms of hydrogen atoms (H) to the sum of the number of atoms of silicon atoms (Si), number of atoms of carbon atoms (C) and number of atoms of hydrogen atoms (H), H/(Si+C+H), in the surface layer is from 0.30 or more to 0.45 or less. This makes an electrophotographic photosensitive member obtainable which has much better electrophotographic photosensitive member performance and much superior high-humidity image flow resistance and wear resistance. The ratio of the number of atoms of hydrogen atoms to the sum of the number of atoms of silicon atoms (Si), number of atoms of carbon atoms (C) and number of atoms of hydrogen atoms (H) is hereinafter also expressed as "H/(Si+C+H)".

In the a-SiC surface layer having a high atom density, the layer has so narrow an optical band gap that it may have a low sensitivity as a result of an increase in light absorption. However, inasmuch as the H/(Si+C+H) in the a-SiC surface layer is 0.30 or more, the layer can have a broad optical band gap, and can contribute to an improvement in sensitivity.

On the other hand, if the H/(Si+C+H) in the a-SiC surface layer is more than 0.45, there is seen a tendency that the a-SiC surface layer has therein terminal groups rich in hydrogen atoms like methyl groups, in a large number. If such terminal groups having a plurality of hydrogen atoms like methyl groups are present in the a-SiC surface layer in a large number, large spaces are formed in the structure of the a-SiC and at the same time the bonding between atoms present around them come to strain. Such structurally weak portions are considered to unwantedly serve as portions that are weak to oxidation. Also, incorporation of hydrogen atoms in the a-SiC surface layer in a large number makes it difficult to promote setup of a network of silicon atoms and carbon atoms which are skeletal atoms of the a-SiC surface layer.

For such reasons, inasmuch as the H/(Si+C+H) is 0.45 or less, it is possible to promote setup of a network of silicon atoms and carbon atoms which are skeletal atoms of the a-SiC surface layer and also to lessen any strain produced in the bonding between the atoms, as so considered. As the result, the a-SiC surface layer can be more improved in its oxidation resistance, and the electrophotographic photosensitive member can be more improved in its wear resistance.

In the present invention, it is also preferable that the ratio of peak intensity of 1,390 cm$^{-1}$ ($I_D$) to peak intensity of 1,480 cm$^{-1}$ ($I_G$), $I_D/I_G$, in a Raman spectrum of the a-SiC surface layer is from 0.20 or more to 0.70 or less. The ratio of peak intensity of 1,390 cm$^{-1}$ to peak intensity of 1,480 cm$^{-1}$ in Raman spectrum is hereinafter also expressed as "$I_D/I_G$".

The Raman spectrum of the a-SiC surface layer is described first, in comparison with diamond-like carbon. The diamond-like carbon is hereinafter also expressed as "DLC".

The Raman spectrum of DLC formed of an sp$^3$ structure and an sp$^2$ structure is observed as a Raman spectrum having a main peak in the vicinity of 1,540 cm$^{-1}$ and a shoulder band in the vicinity of 1,390 cm$^{-1}$. In an a-SiC surface layer formed by an RF-CVD process, a Raman spectrum is observed which is similar to that of DLC and has a main peak in the vicinity of 1,480 cm$^{-1}$ and shoulder band in the vicinity of 1,390 cm$^{-1}$. The reason why the main peak in the Raman spectrum of the a-SiC surface layer stands shifted to the side of a lower wave number than that of DLC is that silicon atoms are contained in the a-SiC surface layer. From this fact, it is seen that the a-SiC surface layer formed by an RF-CVD process is formed of a material having a structure very close to the DLC.

In general, it is known that, in the Raman spectrum of DLC, there is a tendency for the DLC to have higher sp$^3$ content as the ratio of the peak intensity of a low-wave number band to the peak intensity of a high-wave number band is smaller. Thus, it is considered that, in the a-SiC surface layer as well, as having a structure very close to the DLC, it shows a tendency of higher sp$^3$ content as the ratio of the peak intensity of a low-wave number band to the peak intensity of a high-wave number band is smaller.

In the a-SiC surface layer having a high atom density in the present invention, the $I_D/I_G$ in the a-SiC surface layer is 0.70 or less. This enables more improvement of the high-humidity image flow resistance and wear resistance.

As the reason therefor, the present inventors consider that an improvement in sp$^3$ content brings a decrease in the number of two-dimensional networks of sp$^2$ and an increase in three-dimensional networks of sp$^3$, and hence the number of bonds of skeletal atoms increases, so that a strong structure can be formed.

Accordingly, it is much preferable for the $I_D/I_G$ in the a-SiC surface layer to be smaller. However, in a-SiC surface layers formed at a level of mass production, it is unable to remove the sp$^2$ structure completely. Hence, in the present invention, the lower-limit value of the $I_D/I_G$ in the a-SiC surface layer is set at 0.2, at which the improvements in high-humidity image flow resistance and wear resistance have been confirmed in Examples given later.

In the present invention, from the viewpoint of the performance of cleaning of the surface of the electrophotographic photosensitive member by means of a cleaning blade, it is also preferable that the electrophotographic photosensitive member has a surface roughness Ra of from 10 nm or more to 80 nm or less, and much preferably from 10 nm or more to 50 nm or less, as determined from a microscopic surface profile obtained when its surface is measured with an atomic force microscope (AFM) in the range of 10 μm×10 μm. The surface roughness Ra is hereinafter also simply expressed as "Ra".

From the viewpoint of the same cleaning performance as the above, it is also preferable that the electrophotographic photosensitive member has an arithmetic mean slope Δa of from 0.10 or more to 0.40 or less as determined from a microscopic surface profile obtained when its surface is measured with an AFM in the range of 10 μm×10 μm. The arithmetic mean slope Δa is hereinafter also simply expressed as "Δa".

In the present invention, the above a-SiC surface layer may be formed by any method as long as it is a method which can form the layer that satisfies the above prescriptions. Stated specifically, it may include a plasma-assisted CVD process, a vacuum deposition process, a sputtering process and an ion plating process. Of these, the plasma-assisted CVD process is preferred in view of, e.g., readiness in feeding source materials.

How to form the a-SiC surface layer is as described below when the plasma-assisted CVD process is employed as a method for forming the a-SiC surface layer.

That is, a source gas for feeding silicon atoms and a source gas for feeding carbon atoms are each introduced in the desired gaseous state into a reactor the interior of which can be evacuated. Then, glow discharge may be caused to take place in the reactor to decompose the source gases introduced thereinto, whereby the layer made up of a-SiC may be formed on a substrate kept placed at a stated position.

As the source gas for feeding silicon atoms, preferably usable are, e.g., silanes such as silane ($SiH_4$) and disilane ($Si_2H_6$). Also, as the source gas for feeding carbon atoms, preferably usable are e.g., gases such as methane ($CH_4$) and acetylene ($C_2H_2$). In order to control the H/(Si+C+H), hydrogen gas ($H_2$) may also be used together with the above source gases.

In forming the a-SiC surface layer in the present invention, there is a tendency that the Si+C atom density becomes higher by making lower the flow rates of gases fed into the reactor, by making high-frequency power higher or by making the temperature of the substrate higher. In practice, it may be set by combining these conditions appropriately.

Photoconductive Layer

In the present invention, the photoconductive layer may be any layer as long as it is a layer having photoconductive properties that can satisfy performance concerning electrophotographic performance. From the viewpoint of durability and stability, preferred is a photoconductive layer made up of hydrogenated amorphous silicon. The hydrogenated amorphous silicon is hereinafter also expressed as "a-Si".

In the present invention, in the case when the photoconductive layer made up of a-Si is used as the photoconductive layer, halogen atoms may be incorporated in addition to the hydrogen atoms in order to compensate unbonded arms present in the a-Si.

The hydrogen atoms (H) and the halogen atoms (X) may preferably be in a total content (H+X) of 10 atom % or more, and much preferably 15 atom % or more, based on the sum (Si+H+X) of silicon atoms (Si), hydrogen atoms (H) and halogen atoms (X). These may on the other hand preferably be in a total content (H+X) of 30 atom % or less, and much preferably 25 atom % or less.

In the present invention, the photoconductive layer may optionally be incorporated therein with atoms for controlling conductivity. The atoms for controlling conductivity may be contained in the photoconductive layer in an evenly uniformly distributed state, or may be contained partly in such a state that they are distributed non-uniformly in the layer thickness direction The atoms for controlling conductivity may include what is called impurities, used in the field of semiconductors. More specifically, usable are atoms belonging to Group 13 of the periodic table, which provide p-type conductivity, or atoms belonging to Group 15 of the periodic table, which provide n-type conductivity. Among the atoms belonging to Group 13 of the periodic table, a boron atom, an aluminum atom and a gallium atom are preferred. Among the atoms belonging to Group 15 of the periodic table, a phosphorus atom and an arsenic atom are preferred.

The atoms for controlling conductivity that are to be incorporated in the photoconductive layer may preferably be in a content of $1\times10^{-2}$ atom ppm or more, much preferably $5\times10^{-2}$ atom ppm or more, and still much preferably $1\times10^{-1}$ atom ppm or more, based on the silicon atoms (Si). They may on the other hand preferably be in a content of $1\times10^{4}$ atom ppm or less, much preferably $5\times10^{3}$ atom ppm or less, and still much preferably $1\times10^{3}$ atom ppm or less.

In the present invention, the photoconductive layer may preferably have a layer thickness of 15 μm or more, and much preferably 20 μm or more, in view of the desired electrophotographic performance to be achieved, economical advantages and so forth. It may on the other hand preferably have a layer thickness of 60 μm or less, preferably 50 μm or less, and still much preferably 40 μm or less. If the photoconductive layer has a layer thickness of less than 15 μm, electric current which will pass through a charging member may increase to tend to accelerate deterioration. If the photoconductive layer has a layer thickness of more than 60 μm, a site which may abnormally grow in a-Si may come large in size, which may specifically be in a size of 50 to 150 μm in the horizontal direction and 5 to 20 μm in the height direction, and may unnegligibly damage some members which rub the surface or may cause image defects.

The photoconductive layer may be made up of a single layer or may be made up of a plurality of layers (e.g., a charge generation layer and a charge transport layer).

As a method for forming the photoconductive layer made up of a-Si, it may include a plasma-assisted CVD process, a vacuum deposition process, a sputtering process and an ion plating process. Of these, the plasma-assisted CVD process is preferred in view of, e.g., readiness in feeding source materials.

How to form the photoconductive layer is described below taking the case of the plasma-assisted CVD process.

To form the photoconductive layer, a source gas for feeding silicon atoms and a source gas for feeding hydrogen atoms are each introduced in the desired gaseous state into a reactor the interior of which can be evacuated. Then, glow discharge may be caused to take place in the reactor to decompose the source gases introduced thereinto, whereby the layer made up of a-Si may be formed on the substrate, which is kept placed at a stated position.

In the present invention, as the source gas for feeding silicon atoms, preferably usable are silanes such as silane ($SiH_4$) and disilane ($Si_2H_6$). As the source gas for feeding hydrogen atoms, hydrogen gas ($H_2$) may also be used in addition to the above silanes.

Where the photoconductive layer is incorporated therein with any of the above halogen atoms, atoms for controlling conductivity, carbon atoms, oxygen atoms, nitrogen atoms and the like, gaseous or readily gasifiable substances containing the respective atoms may appropriately be used as materials.

Substrate

As the substrate, there are no particular limitations thereon as long as it is what has conductivity and can hold thereon the photoconductive layer and surface layer to be formed on its surface, and any substrate may be used. As a material for the substrate, it may include, e.g., metals such as aluminum and iron, and alloys of any of these. Such a substrate having conductivity (a substrate which is conductive) is hereinafter also expressed as "conductive substrate".

Intermediate Layer

In the present invention, it is preferable to provide an intermediate layer between the photoconductive layer and the a-SiC surface layer of the present invention. It is also preferable that the C/(Si+C) in the intermediate layer is from 0.61 or more to 0.75 or less and that the Si+C atom density in the intermediate layer is from $5.50\times10^{22}$atom/cm$^3$ or more to $6.45\times10^{22}$atom/cm$^3$ or less. The intermediate layer may also preferably have a layer thickness of 150 nm or more.

Figure 5A:
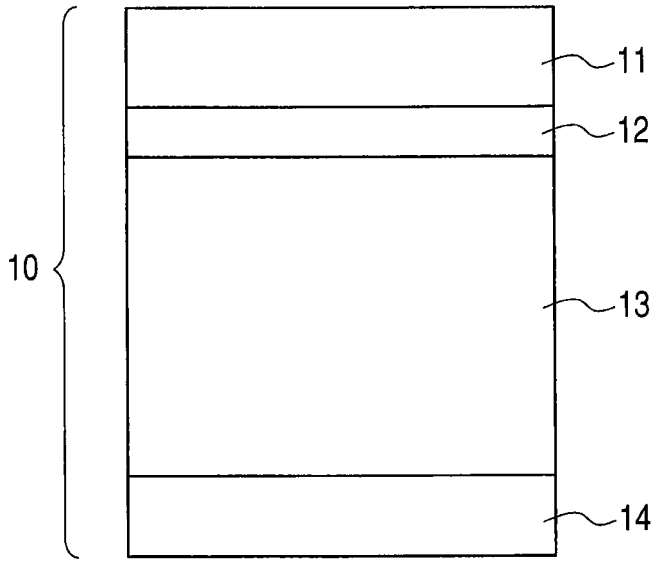
FIGS. 5A and 5B are diagrammatic views showing examples of layer configuration of the electrophotographic photosensitive member of the present invention.

FIG. 5A is a diagrammatic view showing an example of layer configuration of the electrophotographic photosensitive member of the present invention. As shown in FIG. 5A, an electrophotographic photosensitive member 10 has a conductive substrate 14 which is cylindrical and conductive, made of aluminum or the like, and a photoconductive layer 13, an intermediate layer 12 and a surface layer 11 which have been formed in this order on the surface of the substrate 14.

The intermediate layer is described below in detail.

The intermediate layer, which stands in combination with the a-SiC surface layer, brings the effect of protecting the photoconductive layer from any mechanical stress to keep the surface from having pressure scars.

The pressure scars are, as the cause thereof, considered to come about because any foreign matter with a high hardness comes nipped or bitten inside the electrophotographic apparatus by any reason during service to apply a mechanical stress to the surface of the electrophotographic photosensitive member. However, it is not always the case that the surface of the electrophotographic photosensitive member remains marked permanently with scratches. In addition, a case is also seen in which the pressure scars disappear when any electrophotographic photosensitive member having once come marked with pressure scars is heated at 200° C. for 1 hour, for example. Hence, the pressure scars are considered to come about because any excess stress has applied not to the surface itself of the electrophotographic photosensitive member but to the photoconductive layer through the surface layer. Such pressure scars can be kept from coming about, by forming a surface layer with a high hardness. However, in order to keep the photoconductive layer from undergoing any stress, it is deemed necessary for the surface layer to have a minimum layer thickness.

The surface layer of the electrophotographic photosensitive member wears on by degrees with its use over a long period of time, and hence it is necessary for the surface layer to maintain the above minimum layer thickness even after any preset lifetime of the electrophotographic photosensitive member has ended.

In addition, although the a-SiC surface layer in the present invention is one having been improved in oxidation resistance (high-humidity image flow resistance) and wear resistance by improving its Si+C atom density, it shows a tendency to have somewhat low light transmission properties.

Accordingly, the intermediate layer is provided between the photoconductive layer and the a-SiC surface layer of the present invention so that the intermediate layer can be a film which has a lower Si+C atom density than the a-SiC surface layer of the present invention and has relatively good light transmission properties, whereby the electrophotographic photosensitive member can be improved in sensitivity.

Inasmuch as the Si+C atom density in the intermediate layer is set lower than the Si+C atom density in the a-SiC surface layer, it is also presumed that any mechanical stress the a-SiC surface layer may have can more effectively be relaxed. Hence, the pressure scars can more effectively be prevented than a case in which any intermediate layer is not provided.

In order to obtain the above effect, it is necessary for the intermediate layer to have lower atom density and Si+C atom density than the a-SiC surface layer of the present invention. If, however, it has a too low Si+C atom density, the pressure scars preventability of the intermediate layer may come to be damaged. This is because, in order for the intermediate layer to relax the stress effectively, an optimum range exists in a balance between the Si+C atom density in the a-SiC surface layer and that in the intermediate layer, as so considered. Hence, in the present invention, the lower limit value of the Si+C atom density in the intermediate layer is set at $5.50\times10^{22}$atom/cm$^3$, at which the effect of preventing pressure scars has been confirmed.

The effect attributable to the C/(Si+C) in the intermediate layer is substantially the same as the effect in the a-SiC surface layer of the present invention. More specifically, as the C/(Si+C) is smaller, the resistance of the intermediate layer tends to lower to tend to cause a decrease in density due to a lowering of dot reproducibility. Also, as the C/(Si+C) is larger than a certain extent, the light transmission properties decrease to make smaller the effect of improvement in sensitivity that is to be brought by making the Si+C atom density smaller. Accordingly, it is preferable that the C/(Si+C) in the intermediate layer is from 0.61 or more to 0.75 or less.

The intermediate layer is, as described above, required to have the minimum layer thickness in order to prevent the pressure scars, and, in the present invention, an evident effect of preventing pressure scars has been made obtainable by making the intermediate layer have a layer thickness of 150 nm. Here, the layer thickness of the intermediate layer may have no upper limit value for obtaining the effect of preventing pressure scars, but, as the intermediate layer is thicker, it comes that its light transmission properties are damaged correspondingly. Stated specifically, its layer thickness may be 150 nm or more, which may be determined according to the electrophotographic process to be used, and may preferably be about 700 nm or less.

According to studies made by the present inventors, as influence on the light transmission properties of the intermediate layer, the C/(Si+C) and the Si+C atom density are predominant, and any dependence on the H/(Si+C+H) has not been seen so much. This is because the intermediate layer is lower in atom density than the surface layer and this has resulted in a low dependence on the atom density of hydrogen atoms in respect of the light transmission properties, as so considered. The atom density of hydrogen atoms is hereinafter also expressed as "H atom density".

As described above, the combination of the a-SiC surface layer with the intermediate layer brings improvements in high-humidity image flow resistance and wear resistance and at the same time prevents pressure scars effectively, and further achieves an improvement in sensitivity.

Meanwhile, the intermediate layer is not sought for the effect of improving the high-humidity image flow resistance and wear resistance like the a-SiC surface layer of the present invention. Accordingly, it must be supposed that the a-SiC surface layer of the present invention remains on the intermediate layer at a point of time that the preset lifetime of the electrophotographic photosensitive member has lapsed. On the other hand, it is unnecessary for the layer thickness of the a-SiC surface layer of the present invention to take account of the effect of preventing pressure scars as stated above, and hence the layer thickness is presumed to be sufficient if it is 100 nm or more, which depends on the electrophotographic process to be used.

As a method for forming the intermediate layer, the same method as above may be employed, as in the case of forming the surface layer. Then, conditions such as flow rates of gases to be fed to the reactor, high-frequency power, internal pressure of the reactor, substrate temperature and so forth may be set different from those for the surface layer as occasion calls, so as to control the atom density of the intermediate layer to be formed.

Charge Injection Preventing Layer

In the present invention, it is preferable that a charge injection preventing layer having the function to block injection of electric charges from the substrate side is provided between the substrate and the photoconductive layer. More specifically, the charge injection preventing layer is a layer having the function to block injection of electric charges from the substrate into the photoconductive layer when the surface of the electrophotographic photosensitive member is processed to be charged to a stated polarity. In order to impart such function to the layer, in addition to materials making up the photoconductive layer which are used as bases, the charge injection preventing layer is incorporated therein with atoms for controlling conductivity, in a relatively large quantity than the photoconductive layer.

The atoms incorporated in the charge injection preventing layer for controlling its conductivity may be contained in the charge injection preventing layer in an evenly uniformly distributed state, or may be contained partly in such a state that they are distributed non-uniformly in the layer thickness direction. Where they are non-uniform in distribution density, it is preferable for them to be so contained as to be more distributed on the substrate side. In any case, the atoms for controlling conductivity should evenly be contained in the charge injection preventing layer in uniform distribution in the in-plane direction parallel to the surface of the substrate. This is preferable also in view of the achievement of uniformity in properties.

As the atoms incorporated in the charge injection preventing layer for controlling its conductivity, atoms belonging to Group 13 or Group 15 of the periodic table may be used in accordance with charge polarity.

The charge injection preventing layer may further be incorporated therein with at least one kind of atoms selected among carbon atoms, nitrogen atoms and oxygen atoms. This enables improvement in adhesion between the charge injection preventing layer and the substrate.

The at least one kind of atoms selected among carbon atoms, nitrogen atoms and oxygen atoms, contained in the charge injection preventing layer, may be contained in the charge injection preventing layer in an evenly uniformly distributed state, or may be contained uniformly in the layer thickness direction but partly in such a state that they are distributed non-uniformly. In either case, the atoms for controlling conductivity should evenly be contained in the charge injection preventing layer in uniform distribution in the in-plane direction parallel to the surface of the substrate. This is preferable also in view of the achievement of uniformity in properties.

The charge injection preventing layer may preferably have a layer thickness of from 0.1 μm to 15 μm, much preferably from 0.3 μm to 5 μm, and still much preferably from 0.5 μm to 3 μm, in view of the desired electrophotographic performance to be achieved, economical advantages and so forth. Inasmuch as it has a layer thickness of 0.1 μm or more, it can sufficiently have the ability to block injection of electric charges from the substrate, and can promise preferable chargeability. On the other hand, inasmuch as it has a layer thickness of 5 μm or less, any increase in production cost can be prevented which is due to elongation of time for forming the charge injection preventing layer.

In the present invention, the charge injection preventing layer may also be provided between the photoconductive layer and the a-SiC surface layer of the present invention.

The charge injection preventing layer provided beneath the photoconductive layer is hereinafter also expressed as "lower-part charge injection preventing layer". The charge injection preventing layer provided above the photoconductive layer is hereinafter also expressed as "upper-part charge injection preventing layer".

In the present invention, in the case when the upper-part charge injection preventing layer is provided on the photoconductive layer, it is preferable that the intermediate layer is provided between the upper-part charge injection preventing layer and the a-SiC surface layer of the present invention.

Figure 5B:
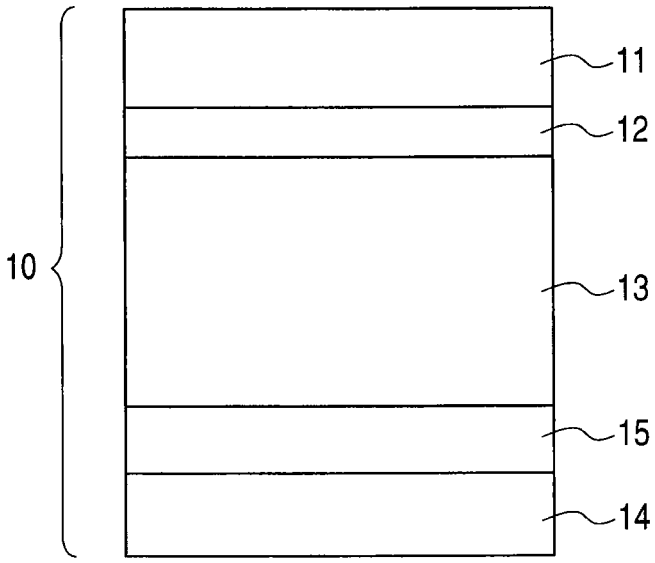

In FIG. 5B, layer configuration of an electrophotographic photosensitive member where the lower-part charge injection preventing layer is formed is diagrammatically shown. As shown in FIG. 5B, an electrophotographic photosensitive member 10 has a substrate 14, and a lower-part charge injection preventing layer 15, a photoconductive layer 13, an intermediate layer 12 and a surface layer 11 which have been formed in this order on the substrate 14.

Between the above respective layers, what is called change layers may optionally be provided which make compositional continuous connection between the respective layers.

Figure 2:
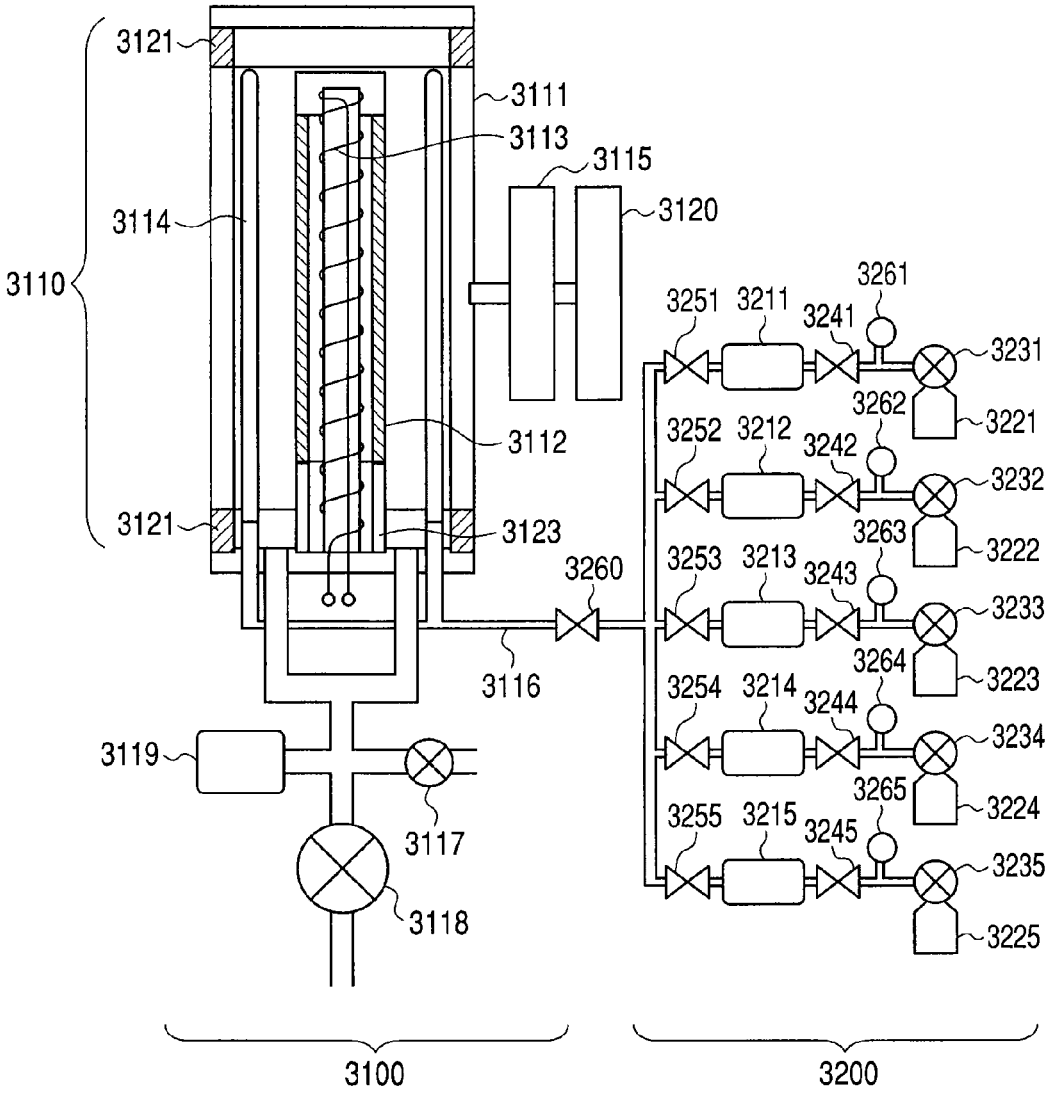
FIG. 2 is a diagrammatic view of a plasma-assisted CVD system used in producing the electrophotographic photosensitive member of the present invention.

Production Apparatus and Method for Producing Electrophotographic Photosensitive Member of the Present Invention FIG. 2 is a diagrammatic view showing an example of an apparatus for producing electrophotographic photosensitive members by RF plasma-assisted CVD making use of a high-frequency power source, used to produce the a-Si electrophotographic photosensitive member of the present invention.

This production apparatus is chiefly constituted of a deposition system 3100 having a reactor 3110, a source gas feed system 3220 and an exhaust system (not shown) for evacuating the inside of the reactor 3110.

In the reactor 3110 in the deposition system 3100, a substrate 3112 connected to the ground, a heater 3113 for heating the substrate, and a source gas feed pipe 3114 are provided. A high-frequency power source 3120 is also connected to a cathode electrode 3111 through a high-frequency matching box 3115.

The source gas feed system 3200 is constituted of source gas cylinders 3221 to 3225, valves 3231 to 3235, pressure controllers 3261 to 3265, gas flow-in valves 3241 to 3245, gas flow-out valves 3251 to 3255, and mass flow controllers 3211 to 3215. The gas cylinders in which the respective source gases are enclosed are connected to the source gas feed pipe 3114 in the reactor 3110 through an auxiliary valve 3260. Reference numeral 3116 denotes a gas pipe; 3117, a leak valve; and 3121, an insulating material.

How to form a deposited film by using this apparatus is described next. First, the substrate 3112, having been degreased and cleaned, is set in the reactor 3110 through a stand 3123. Next, the exhaust system (not shown) is operated to evacuate the inside of the reactor 3110. Then, while watching the indication of a vacuum gauge 3119, the internal pressure of the reactor 3110 is controlled, and, at the time it has come to a stated pressure, e.g., 1 Pa or less, electric power is supplied to the heater 3113 for heating the substrate, to heat the substrate to a stated temperature of, e.g., 50 to 350° C. Here, an inert gas such as Ar or He may be fed into the reactor 3110 by means of the gas feed system 3200 to heat the substrate in an atmosphere of inert gas.

Next, source gases used to form a deposited film are fed into the reactor 3110 by means of the gas feed system 3200. More specifically, the valves 3231 to 3235, the gas flow-in valves 3241 to 2245 and the gas flow-out valves 3251 to 3255 are opened as occasion calls, and mass flow controllers 3211 to 3215 are made to set gas flow rates. At the time the gas flow rates have become stable at the respective mass flow controllers, a main valve 3118 is operated while watching the indication of the vacuum gauge 3119, to adjust the internal pressure of the reactor 3110 to the desired pressure. At the time the desired pressure has come, high-frequency power is supplied from the high-frequency power source 3120 and at the same time the high-frequency matching box 3115 is operated to cause plasma discharge to take place in the reactor 3110. Thereafter, the high-frequency power is immediately adjusted to the desired power, where the deposited film is formed.

At the time the formation of a stated deposited film has been completed, the supply of high-frequency power is stopped, and then the valves 3231 to 3235, the gas flow-in valves 3241 to 3245, the gas flow-out valves 3251 to 3255 and the auxiliary valve 3260 are closed to finish the feeding of source gases. At the same time, the main valve 3118 is full opened to evacuate the inside of the reactor 3110 to a pressure of 1 Pa or less.

Thus, the formation of the deposited film is completed. Where a plurality of deposited films are formed, the above procedure may be repeated to form the respective layers. Source gas flow rates, pressure and so forth may also be changed with stated time to the conditions for forming the photoconductive layer, to form junction regions.

After the formation of all deposited films has been completed, the main valve 3118 is closed, where an inert gas is fed into the reactor 3110 to return its internal pressure to atmospheric pressure, and thereafter the substrate 3112 with deposited films is taken out.

In the electrophotographic photosensitive member of the present invention, a surface layer with film structure having a high atom density is formed at a higher density of Si+C atoms constituting the a-SiC, than any surface layers of conventional electrophotographic photosensitive members. In the case when the a-SiC surface layer of the present invention, having a high atom density, is formed as described above, the gases fed into the reactor may preferably be in a smaller volume, the high-frequency power may preferably be higher and the internal pressure of the reactor may preferably be higher, and further the substrate temperature may preferably be higher.

First, the source gases may be fed into the reactor in a smaller volume and also a higher high-frequency power may be supplied, whereby the decomposition of gases can be accelerated. This enables well efficient decomposition of the gas for feeding carbon atoms that is decomposable with greater difficulty than the gas for feeding silicon atoms. As the result, active species with less hydrogen atoms are formed to lessen hydrogen atoms in the deposited film(s) formed on the substrate, and hence the a-SiC surface layer having a high atom density can be formed.

Second, the reactor may be set at a higher internal pressure, and this makes longer the retention time of source gases fed into the reactor and causes the reaction of extracting weakly bonded hydrogen in virtue of hydrogen atoms produced upon decomposition of the source gases. As the result, network formation of silicon atoms and carbon atoms is promoted, as so considered.

Further, the substrate temperature may be heated to a higher temperature, and this makes longer the distance of surface movement of active species having reached the substrate, and can make stabler bonds. As the result, the respective atoms can be bonded in structurally more stable configuration for the a-SiC surface layer, as so considered.

Electrophotographic Apparatus Making Use of Electrophotographic Photosensitive Member of the Present Invention How to form images by means of an electrophotographic apparatus making use of the a-Si electrophotographic photosensitive member is described with reference to FIG. 4.

First, an electrophotographic photosensitive member 6001 is rotated so as to make the surface of the electrophotographic photosensitive member 6001 more uniformly charged with a primary charging assembly 6002. Thereafter, the surface of the electrophotographic photosensitive member 6001 is exposed to imagewise exposure light by an electrostatic latent image forming means (imagewise exposure means) 6006 to form an electrostatic latent image on the surface of the electrophotographic photosensitive member 6001, which latent image is thereafter developed with a toner fed by a developing assembly 6012. As the result, a toner image is formed on the surface of the electrophotographic photosensitive member 6001. Then, this toner image is transferred to a transfer material 6010 by means of a transfer charging assembly 6004, and this transfer material 6010 is separated from the electrophotographic photosensitive member 6001 by means of a separation charging assembly 6005, after which the toner image is fixed to the transfer material 6010 by a fixing means (not shown).

Meanwhile, the toner remaining on the surface of the electrophotographic photosensitive member 6001 from which the toner image has been transferred to the transfer material 6010 is removed with a cleaner 6009, and thereafter the surface of the electrophotographic photosensitive member 6001 is exposed to light to eliminate any residual carriers coming during the formation of the electrostatic latent image on the electrophotographic photosensitive member 6001.

A series of the above process is repeated to form images continuously. Reference numeral 6003 denotes a charge eliminator; 6007, a magnet roller; 6008, a cleaning blade; and 6011, a transport means.

There are no particular limitations on the electrophotographic apparatus to which the electrophotographic photosensitive member of the present invention is mounted. For example, even in the conventional electrophotographic apparatus shown in FIG. 4, the electrophotographic photosensitive member of the present invention can obtain better effects than any conventional electrophotographic photosensitive members in respect of high-humidity image flow resistance and wear resistance.

However, in an environment having a very high absolute humidity, the high-humidity image flow chiefly due to "image flow below charger" may occur.

Under such circumstances, any electrophotographic photosensitive member making use of the electrophotographic photosensitive member of the present invention may be provided therein with a shielding member which can shield an opening of charging assembly that faces the electrophotographic photosensitive member. This can bring much greater effects in keeping the high-humidity image flow from occurring.

With such make-up, even where any charge products which are one of the causes of the image flow below charger have come about in a large quantity, such charge products can be kept from adhering to the surface of the electrophotographic photosensitive member, by inserting the shielding member between the charging assembly and the electrophotographic photosensitive member at the time of completion of each electrophotographic process.

As the result, not only its surface can be made low adsorptive by keeping the surface of the a-SiC surface layer of the present invention from being oxidized, but also the charge products can be made less come about. Hence, even in an electrophotographic process causative of much formation of charge products, much greater effects can be obtained in keeping the high-humidity image flow from occurring.

Regarding how to shield the opening of charging assembly that faces the electrophotographic photosensitive member and how to set up the charging assembly having a shielding member and the shielding member, any conventional method and construction may be employed as long as the opining of the charging assembly can be shielded at the time of completion of each electrophotographic process and can be opened at the time of its start. As an example of a conventionally known shielding member, it may include the one disclosed in Japanese Patent Laid-open Application No. H10-104911.

As an example of the conventionally known shielding member which shields the opening of charging assembly that faces the electrophotographic photosensitive member, it is described taking the case of a charging means so set up that a corona charging assembly is provided with the shielding member.

Figure 3A:
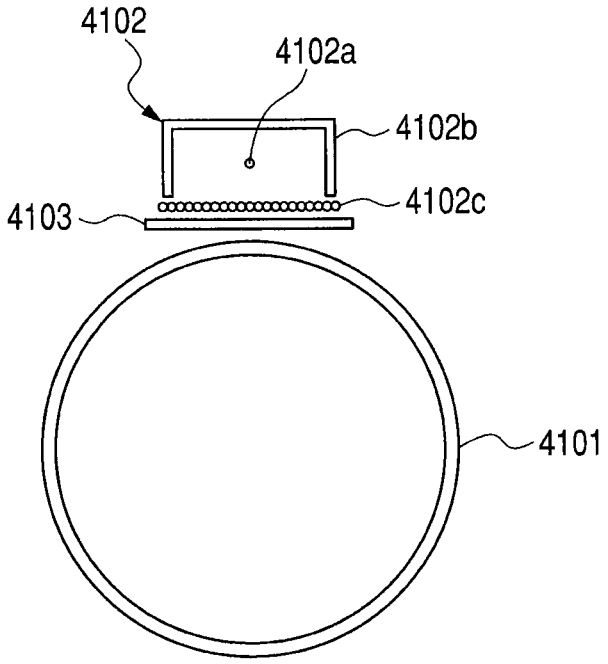
FIG. 3A is a schematic view of a scorotron charging assembly usable preferably in the present invention.
Figure 3B:
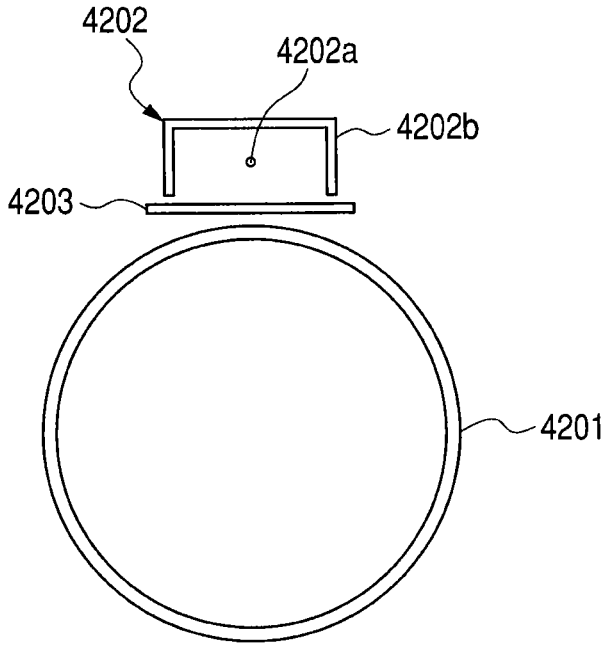
FIG. 3B is a schematic view of a corotron charging assembly usable preferably in the present invention.

FIGS. 3A and 3B are diagrammatic schematic views showing examples of the shielding member.

A corona charging means shown in FIG. 3A is made up of a scorotron charging assembly 4102 and a shielding member 4103. The scorotron charging assembly 4102 is formed of a charging wire 4102*a*, a housing 4102*b* and a grid wire 4102*c*, and is disposed facing an electrophotographic photosensitive member 4101. The shielding member 4103 is disposed at an opening of the scorotron charging assembly 4102. The shielding member 4103 is so set up that it is movable by a moving means (not shown) up to an escape position where it does not affect corona charging when the corona charging is in the on state.

In the corona charging means with such construction, the shielding member 4103 is, upon completion of each print job, moved from the escape position to a closing position to close the opening of the scorotron charging assembly 4102. Thus, any charge products floating inside the scorotron charging assembly 4102 come adsorbed on the inner surface of the shielding member 4103, and hence can be kept from being adsorbed on the surface of the electrophotographic photosensitive member. Such a scorotron type corona charging assembly as shown in FIG. 3A may preferably be used as, e.g., a primary charging assembly.

A corona charging means also shown in FIG. 3B is made up of a corotron charging assembly 4202 and a shielding member 4203. The corotron charging assembly 4202 is formed of a charging wire 4202*a* and a housing 4202*b*, and is disposed facing an electrophotographic photosensitive member 4201. The shielding member 4203 is disposed at an opening of the corotron charging assembly 4202. It has the same construction as that in FIG. 3A except that its charging system is changed from the scorotron type to the corotron type. Such a corotron type corona charging assembly as shown in FIG. 3B may preferably be used as, e.g., a transfer charging assembly.

There are also no particular limitations on materials for the shielding member, and any material may be used as long as it can shield the opening of charging assembly that faces the electrophotographic photosensitive member.

EXAMPLES

The present invention is described below in greater detail by giving Examples and Comparative Examples, which, however, by no means limit the present invention.

Example 1

Using the plasma-assisted processing system shown in FIG. 2, making use of a high-frequency power source having an RF band as a frequency band, the following layers were formed on a cylindrical substrate (a mirror-finished cylindrical conductive substrate made of aluminum, of 80 mm in diameter, 358 mm in length and 3 mm in wall thickness) under conditions shown in Table 1, to produce positive-charging a-Si electrophotographic photosensitive members. The layers were formed in the order of the charge injection preventing layer, the photoconductive layer and the surface layer, and the high-frequency power, $SiH_4$ flow rate and $CH_4$ flow rate in forming the surface layer were set under conditions shown in Table 2 below. The electrophotographic photosensitive members were also each produced in a number of two for each of the film forming conditions.

In Examples 1 to 6 and Comparative Examples 1 to 7 each, a cathode of 258 mm in inner diameter was used as the cathode 3111.

TABLE 1

| | Charge injection preventing layer | Photo-conductive layer | Surface layer |
|---|---|---|---|
| Gases & gas flow rates: | | | |
| $SiH_4$ [mL/min(normal)] | 350 | 450 | * |
| $H_2$ [mL/min(normal)] | 750 | 2,200 | — |
| $B_2H_6$ (ppm)(based on $SiH_4$) | 1,500 | 1 | — |
| NO [ml/min(normal)] | 10 | — | — |
| $CH_4$ [ml/min(normal)] | — | — | * |
| Internal pressure (Pa) | 40 | 80 | 80 |
| High-frequency power (W) | 400 | 800 | * |
| Substrate temperature (° C.) | 260 | 260 | 290 |
| Layer thickness (μm) | 3 | 25 | 0.5 |

In Table 1, "Charge injection preventing layer" is the lower-part charge injection preventing layer.

TABLE 2

| Film forming conditions No. | 1 | 2 | 3 | 4 |
|---|---|---|---|---|
| $SiH_4$ [mL/min(normal)] | 26 | 26 | 26 | 26 |
| $CH_4$ [ml/min(normal)] | 500 | 450 | 400 | 360 |
| High-frequency power (W) | 800 | 750 | 750 | 700 |

About the two electrophotographic photosensitive members for each of the film forming conditions, produced in Example 1, the surface roughness was measured under conditions set out later, to calculate the values of Ra and Δa. Thereafter, using one electrophotographic photosensitive member for each of the film forming conditions, the C/(Si+C), the Si atom density, the C atom density, the Si+C atom density, the H/(Si+C+H), the H atom density and the $sp^3$ content were determined according to analytical methods described later. Then, using the remaining one electrophotographic photosensitive member for each of the film forming conditions, evaluation was made on high-humidity image flow 1, wear resistance, gradation and sensitivity under evaluation conditions set out later. Results obtained on these are shown in Table 5.

Comparative Example 1

Like Example 1, using the plasma-assisted processing system shown in FIG. 2, making use of a high-frequency power source having an RF band as a frequency band, the like layers were formed on the cylindrical substrate under conditions shown in Table 1 above, to produce two positive-charging a-Si electrophotographic photosensitive members; provided that the high-frequency power, $SiH_4$ flow rate and $CH_4$ flow rate in forming the surface layer were set under conditions shown in Table 3 below.

TABLE 3

| Film forming conditions No. | 5 |
|---|---|
| $SiH_4$ [mL/min(normal)] | 26 |
| $CH_4$ [ml/min(normal)] | 500 |
| High-frequency power (W) | 750 |

About the electrophotographic photosensitive members produced in Comparative Example 1, the values of surface roughness were calculated and thereafter the C/(Si+C), the Si atom density, the C atom density, the Si+C atom density, the H/(Si+C+H), the H atom density and the $sp^3$ content were determined all in the same way as in Example 1. Evaluation was also made on the high-humidity image flow 1, wear resistance, gradation and sensitivity in the same way as in Example 1. Results obtained on these are shown in Table 5.

Comparative Example 2

Using the plasma-assisted processing system shown in FIG. 2, making use of a high-frequency power source having an RF band as a frequency band, the following layers were formed on the cylindrical substrate under conditions shown in Table 4, to produce two positive-charging a-Si electrophotographic photosensitive members.

TABLE 4

| | Charge injection preventing layer | Photo-conductive layer | Surface layer |
|---|---|---|---|
| Gases & gas flow rates: | | | |
| $SiH_4$ [mL/min(normal)] | 350 | 450 | 26 |
| $H_2$ [mL/min(normal)] | 750 | 2,200 | — |
| $B_2H_6$ (ppm)(based on $SiH_4$) | 1,500 | 1 | — |
| NO [ml/min(normal)] | 10 | — | — |
| $CH_4$ [ml/min(normal)] | — | — | 1,400 |
| Internal pressure (Pa) | 40 | 80 | 55 |
| High-frequency power (W) | 400 | 800 | 400 |
| Substrate temperature (° C.) | 260 | 260 | 260 |
| Layer thickness (μm) | 3 | 25 | 0.5 |

In Table 4, "Charge injection preventing layer" is the lower-part charge injection preventing layer.

About the electrophotographic photosensitive members produced in Comparative Example 2, the values of surface roughness were calculated and thereafter the C/(Si+C), the Si atom density, the C atom density, the Si+C atom density, the H/(Si+C+H), the H atom density and the $sp^3$ content were determined all in the same way as in Example 1. Evaluation was also made on the high-humidity image flow 1, wear resistance, gradation and sensitivity in the same way as in Example 1. Results obtained on these are shown in Table 5. The film forming conditions for the electrophotographic photosensitive members produced in Comparative Example 2 are denoted therein as No. 6.

Measurement of C/(Si+C) and Measurement of Si+C Atom Density and H/(Si+C+H)

First, a reference electrophotographic photosensitive member was produced in which only the charge injection preventing layer and photoconductive layer shown in Table 1 were formed. Then, this was cut out in a square shape of 15 mm square at a middle portion thereof in its lengthwise direction at its arbitrary position in peripheral direction to prepare a reference sample.

Next, the electrophotographic photosensitive member in which the charge injection preventing layer, the photoconductive layer and the surface layer were formed was likewise cut out to prepare a sample for measurement.

The reference sample and the sample for measurement were measured by spectroscopic ellipsometry (using a high-speed spectroscopic ellipsometer M-2000, manufactured by J.A. Woollam Co., Inc.) to determine the layer thickness of the surface layer.

Specific conditions for the measurement by spectroscopic ellipsometry are incident angles: 60°, 65° and 70°; measurement wavelength: 195 nm to 700 nm; and beam diameter: 1 mm×2 mm.

First, the reference sample was measured by spectroscopic ellipsometry to find the relationship between the wavelength and the amplitude ratio ψ and phase difference Δ at each incident angle.

Next, setting as a reference the results measurement on the reference sample, the sample for measurement was measured in the same way as the reference sample by spectroscopic ellipsometry to determine the relationship between the wavelength and the amplitude ratio ψ and phase difference Δ at each incident angle.

Further, a layer structure in which the charge injection preventing layer, the photoconductive layer and the surface layer were formed in this order and which had a roughness layer where the surface layer and a pneumatic layer were present together at the outermost surface was used as a calculation model, and, changing in volume ratio the surface layer and pneumatic layer of the roughness layer, the relationship between the wavelength and the ψ and Δ at each incident angle was found by calculation, using an analytical software. Then, a calculation model was picked out on which the relationship between the wavelength and the ψ and Δ at each incident angle that was found by this calculation and the relationship between the wavelength and the ψ and Δ at each incident angle that was found by measuring the sample for measurement came minimal in their mean square error. The layer thickness of the surface layer was calculated according to the calculation model thus picked out, and the value obtained was taken as the layer thickness of the surface layer. Here, WVASE 32, available from J.A. Woollam Co., Inc., was used as the analytical software. Also, in regard to the volume ratio of the surface layer and pneumatic layer of the roughness layer, the proportion of the pneumatic layer in the roughness layer, surface layer:pneumatic layer, was changed at intervals of 1 from 10:0 to 1:9 to make calculation. In the positive-charging a-Si electrophotographic photosensitive members produced in the present Example under the respective film forming conditions, the relationship between the wavelength and the ψ and Δ that was found by calculation and the relationship between the wavelength and the ψ and Δ that was found by measurement came minimal in their mean square error when the surface layer and the pneumatic layer were 8:2 in their volume ratio.

After the measurement made by spectroscopic ellipsometry was finished, the above sample for measurement was analyzed by RBS (Rutherford back scattering) (using a back scattering analyzer AN-2500, manufactured by Nisshin High Voltage Co., Ltd.) to measure the number of atoms of silicon atoms and number of atoms of carbon atoms in the surface layer within the area of measurement by RBS. The C/(Si+C) was found from the number of atoms of silicon atoms and number of atoms of carbon atoms thus measured. Next, for the silicon atoms and carbon atoms determined from the area of measurement by RBS, the Si atom density, the C atom density and the Si+C atom density were determined by using the layer thickness of surface layer that was determined by spectroscopic ellipsometry.

Simultaneously with the RBS, the sample for measurement was analyzed by HFS (hydrogen forward scattering) (using a back scattering analyzer AN-2500, manufactured by Nisshin High Voltage Co., Ltd.) to measure the number of atoms of hydrogen atoms in the surface layer within the area of measurement by HFS. The H/(Si+C+H) was found according to the number of atoms of hydrogen atoms determined from the area of measurement by HFS and the number of atoms of silicon atoms and number of atoms of carbon atoms determined from the measurement by RBS.

Next, for the number of atoms of hydrogen atoms determined from the area of measurement by HFS, the H atom density was determined by using the layer thickness of surface layer that was determined by spectroscopic ellipsometry.

Specific conditions for the measurement by RBS and HFS were incident ions: $4He^{+}$, incident energy: 2.3 MeV, incident angle: 75°, sample electric current: 35 nA, and incident beam diameter: 1 mm; as a detector for the RBS, scattering angle: 160°, and aperture diameter: 8 mm; and as a detector for the HFS, recoil angle: 30°, and aperture diameter: 8 mm+Slit; under which the measurement was made.

Evaluation 1 on High-Humidity Image Flow

Evaluation 1 on high-humidity image flow concerns how to make evaluation on image flow during running. The image flow during running to be evaluated by the evaluation 1 on high-humidity image flow is also expressed as "high-humidity image flow 1".

Figure 4:
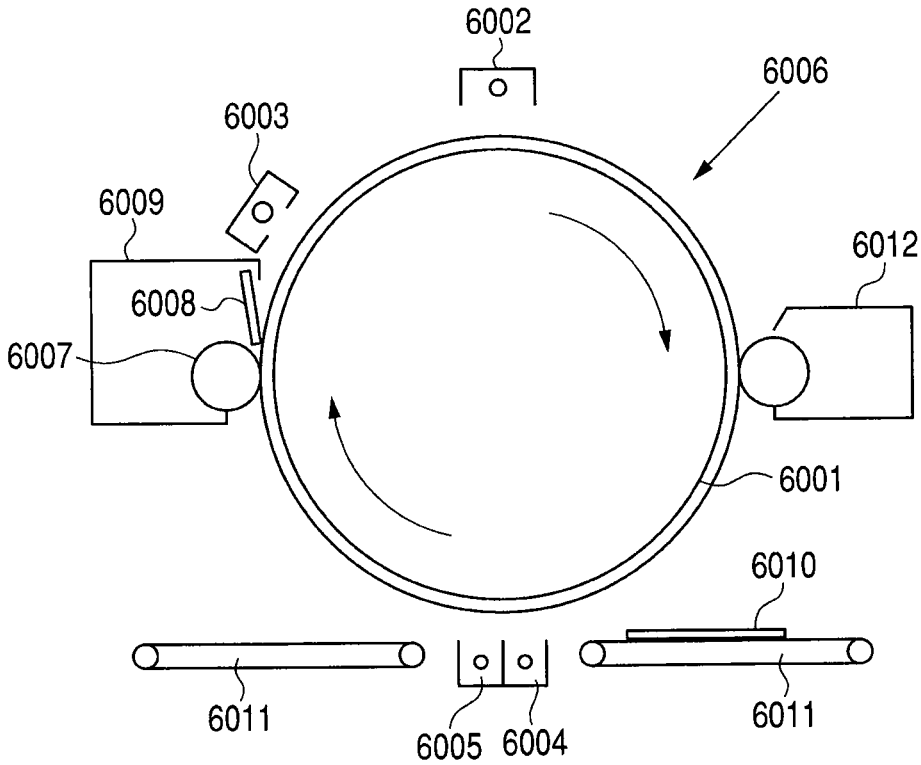
FIG. 4 is a schematic sectional view of an electrophotographic apparatus used in Examples.

The electrophotographic apparatus set up as shown in FIG. 4 was readied as an electrophotographic apparatus used for the evaluation 1 on high-humidity image flow. Stated more specifically, it is a digital electrophotographic apparatus "iR-5065" (trade name), manufactured by CANON INC.

The electrophotographic photosensitive members produced were each set in the above electrophotographic apparatus, and an A3-size character chart (4 pt, print percentage: 4%) was reproduced before a continuous paper feed test in a high-humidity environment of temperature 25° C. and relative humidity 75% (volumetric absolute humidity: 17.3 $g/cm^3$). At this stage, this was conducted under conditions where a photosensitive member heater was kept in the on state.

After images were reproduced before a continuous paper feed test, the continuous paper feed test was conducted. When the continuous paper feed test was conducted, it was conducted under conditions where the photosensitive member heater was always kept in the off state during both the time that the electrophotographic apparatus stood operated to conduct the continuous paper feed test and the time that the electrophotographic apparatus stood stopped.

Stated specifically, using an A4-size test pattern with a print percentage of 1%, a continuous paper feed test on 25,000 sheets per day was conducted for 10 days on up to 250,000 sheets. After the continuous paper feed test was finished, the electrophotographic apparatus was left to stand for 15 hours in the environment of temperature 25° C. and relative humidity 75%.

After 15 hours, the apparatus was started to operate while the photosensitive member heater was kept in the off state, and the A3-size character chart (4 pt, print percentage: 4%) was reproduced. The images reproduced before the continuous paper feed test and the images reproduced after the continuous paper feed test (i.e., after leaving for 15 hours after the test; the same applies in this evaluation item) were each made electronic into a PDF (portable document file) under binary conditions of monochromatic 300 dpi by using a digital electrophotographic apparatus "iRC-5870" (trade name), manufactured by CANON INC.

The images having been made electronic were processed by using an image editing software ADOBE PHOTOSHOP (trade name), available from Adobe Systems Incorporated, to measure their black percentage in an image area (251.3 mm×273 mm) corresponding to one round of the electrophotographic photosensitive member. Next, the proportion of black percentage of the images reproduced after the continuous paper feed test to black percentage of the images reproduced before the continuous paper feed test was found to make evaluation on the high-humidity image flow.

Where the high-humidity image flow has occurred, blurred characters or letters are formed over the whole images, or characters or letters are not printed to cause blank areas in images. Hence, when compared with normal images formed before the continuous paper feed test, the images reproduced have a lower black percentage. Thus, it follows that, the closer to 100% the proportion of black percentage of the images reproduced after the continuous paper feed test to black percentage of the normal images before the continuous paper feed test is, the better the high-humidity image flow is prevented. Incidentally, for the evaluation 1 on high-humidity image flow, the effect to be brought by the present invention is judged to have been obtained when evaluated as "D" or higher.

A: The proportion of black percentage of the images reproduced after the continuous paper feed test to black percentage of the images before the continuous paper feed test is from 95% or more to 105% or less.

B: The proportion of black percentage of the images reproduced after the continuous paper feed test to black percentage of the images before the continuous paper feed test is from 90% or more to less than 95%.

C: The proportion of black percentage of the images reproduced after the continuous paper feed test to black percentage of the images before the continuous paper feed test is from 85% or more to less than 90%.

D: The proportion of black percentage of the images reproduced after the continuous paper feed test to black percentage of the images before the continuous paper feed test is from 80% or more to less than 85%.

E: The proportion of black percentage of the images reproduced after the continuous paper feed test to black percentage of the images before the continuous paper feed test is from 70% or more to less than 80%.

F: The proportion of black percentage of the images reproduced after the continuous paper feed test to black percentage of the normal images before the continuous paper feed test is less than 70%.

Evaluation of Wear Resistance

As a method for evaluating the wear resistance, the layer thickness of the surface layer of each electrophotographic photosensitive member standing immediately after its production was measured at 9 spots in the lengthwise direction of the electrophotographic photosensitive member (at 0 mm, ±50 mm, ±90 mm, ±130 mm and ±150 mm from the middle of the electrophotographic photosensitive member in its lengthwise direction) at its arbitrary position in peripheral direction and at 9 spots in the lengthwise direction thereof at a position where the electrophotographic photosensitive member was rotated by 180° from the above arbitrary position in peripheral direction, at 18 spots in total, and was calculated from an average value of the values at the 18 spots.

As a measuring method, the surface of the electrophotographic photosensitive member was vertically irradiated with light in a spot diameter of 2 mm, and the reflected light was measure by spectrometry using a spectrometer (MCPD-2000, manufactured by Otuska Electronics Co., Ltd.). The layer thickness of the surface layer was calculated on the basis of reflection waveforms obtained. Here, the wavelength range was from 500 nm to 750 nm, the photoconductive layer had a refractive index of 3.30, and, as a refractive index of the surface layer, the value found by the measurement by spectroscopic ellipsometry was used which was made when the Si+C atom density was measured as described previously.

After the layer thickness was measured, like the evaluation 1 on high-humidity image flow, the electrophotographic photosensitive member produced was set in the digital electrophotographic apparatus "iR-5065" (trade name), manufactured by CANON INC., and the continuous paper feed test was conducted in the same way as in the evaluation 1 on high-humidity image flow in a high-humidity environment of temperature 25° C. and relative humidity 75%. After the 250,000-sheet continuous paper feed test was finished, the electrophotographic photosensitive member was taken out of the electrophotographic apparatus, where the layer thickness of its surface layer was measured at the same position as that immediately after production, and the layer thickness of the surface layer after the continuous paper feed test was calculated in the same way as that immediately after production. Then, a difference was found from average layer thickness of the surface layers standing immediately after production and after the continuous paper feed test, to calculate the depth of wear in 250,000-sheet testing. Then, the proportion of the difference in average layer thickness of such surface layers of each electrophotographic photosensitive member to the difference in average layer thickness of the surface layers standing immediately after production and after the continuous paper feed test, of the electrophotographic photosensitive member produced under the film forming conditions No. 6 in Comparative Example 2 was found to make relative evaluation. Incidentally, for the evaluation of wear resistance, the effect to be brought by the present invention is judged to have been obtained when evaluated as "D" or higher.

A: The proportion of the difference in average layer thickness of the above surface layers of each of the electrophotographic photosensitive members produced under the respective film forming conditions to the difference in average layer thickness of the above surface layers of the electrophotographic photosensitive member produced under the film forming conditions No. 6 in Comparative Example 2 is 60% or less.

B: The proportion of the difference in average layer thickness of the above surface layers of each of the electrophotographic photosensitive members produced under the respective film forming conditions to the difference in average layer thickness of the above surface layers of the electrophotographic photosensitive member produced under the film forming conditions No. 6 in Comparative Example 2 is more than 60% to 70% or less.

C: The proportion of the difference in average layer thickness of the above surface layers of each of the electrophotographic photosensitive members produced under the respective film forming conditions to the difference in average layer thickness of the above surface layers of the electrophotographic photosensitive member produced under the film forming conditions No. 6 in Comparative Example 2 is more than 70% to 80% or less.

D: The proportion of the difference in average layer thickness of the above surface layers of each of the electrophotographic photosensitive members produced under the respective film forming conditions to the difference in average layer thickness of the above surface layers of the electrophotographic photosensitive member produced under the film forming conditions No. 6 in Comparative Example 2 is more than 80% to 90% or less.

E: The proportion of the difference in average layer thickness of the above surface layers of each of the electrophotographic photosensitive members produced under the respective film forming conditions to the difference in average layer thickness of the above surface layers of the electrophotographic photosensitive member produced under the film forming conditions No. 6 in Comparative Example 2 is more than 90% to 100% or less.

F: The proportion of the difference in average layer thickness of the above surface layers of each of the electrophotographic photosensitive members produced under the respective film forming conditions to the difference in average layer thickness of the above surface layers of the electrophotographic photosensitive member produced under the film forming conditions No. 6 in Comparative Example 2 is 100% or more.

Evaluation of Gradation

Evaluation of gradation was made using a conversion machine of the digital electrophotographic apparatus "iR-5065" (trade name), manufactured by CANON INC. Then, first, using an area coverage modulation dot screen formed at 45 degrees and a line density of 170 lpi (170 lines per 1 inch) by imagewise exposure light, gradation data were prepared in which the whole gradation range was equally distributed at 17 stages according to area coverage modulation (i.e., area coverage modulation of dot areas imagewise exposed to light). Here, a number was so allotted for each gradation as to give a number "17" to the darkest gradation and a number "0" to the lightest gradation to provide gradation stages.

Next, the electrophotographic photosensitive member produced was set in the above conversion electrophotographic apparatus, and images were reproduced on A3-size sheets in a text mode by using the above gradation data. Here, since the evaluation of gradation is affected if the high-humidity image flow occurs, the images were reproduced in an environment of temperature 22° C. and relative humidity 50% and under such conditions that the photosensitive member heater was placed in the on state to keep the surface of the electrophotographic photosensitive member at about 40° C.

On the images obtained, image density was measured with a reflection densitometer (a spectro-densitometer X-rite 504, manufactured by X-rite, Incorporated) for each gradation. In the measurement of reflection density, images were reproduced on three sheets for each gradation, and an average value of their densities was taken as an evaluation value.

A correlation coefficient between the evaluation value thus found and each gradation stage was calculated to find a difference thereof from a correlation coefficient =1.00 that is the case that the representation of gradation in which the reflection density at each gradation changes perfectly linearly was obtained. Then, the ratio of a difference therefrom calculated from the correlation coefficient due to each of the electrophotographic photosensitive members produced under the respective film forming conditions to a difference therefrom calculated from the correlation coefficient due to the electrophotographic photosensitive member produced under the film forming conditions No. 2 was taken as an index of the gradation to make evaluation. In this evaluation, it shows that, the smaller the numerical value is, the better the gradation is and the more closely linearly the gradation is represented. Incidentally, for the evaluation of gradation, the effect to be brought by the present invention is judged to have been obtained when evaluated as "A".

A: The ratio of a difference from the correlation coefficient=1.00, calculated form the correlation coefficient due to the electrophotographic photosensitive member produced under each film forming conditions, to a difference from the correlation coefficient=1.00, calculated form that due to the electrophotographic photosensitive member produced under the film forming conditions No. 2, is 1.80 or less.

B: The ratio of a difference from the correlation coefficient=1.00, calculated form the correlation coefficient due to the electrophotographic photosensitive member produced under each film forming conditions, to a difference from the correlation coefficient=1.00, calculated form that due to the electrophotographic photosensitive member produced under the film forming conditions No. 2, is more than 1.80.

Evaluation of Sensitivity

A conversion machine of the digital electrophotographic apparatus "iR-5065" (trade name), manufactured by CANON INC., was used. In the state the imagewise exposure was turned off, a high-pressure power source was connected to each of a wire and a grid of its charging assembly, where, setting the grid potential at 820 V, the electric current flowed to the wire of the charging assembly was controlled so as to set the surface potential of the electrophotographic photosensitive members at 400 V.

Next, in the state the electrophotographic photosensitive member was charged under the charging conditions set as above, its surface was irradiated with imagewise exposure light, and its irradiation energy was controlled to set the surface potential of the electrophotographic photosensitive member at 100 V at its position where it faced the developing assembly.

A light source of imagewise exposure of the electrophotographic photosensitive member used in the evaluation of sensitivity was a semiconductor laser having a lasing wavelength of 658 nm. The result of evaluation was indicated as relative comparison, assuming as 1.00 the irradiation energy applied when the electrophotographic photosensitive member produced under the film forming conditions No. 6 in Comparative Example 2 was mounted. Incidentally, for the evaluation of sensitivity, the effect to be brought by the present invention is judged to have been obtained when evaluated as "B" or higher.

A: The ratio of irradiation energy to the irradiation energy for the electrophotographic photosensitive member produced under the film forming conditions No. 6 in Comparative Example 2 is less than 1.10.

B: The ratio of irradiation energy to the irradiation energy for the electrophotographic photosensitive member produced under the film forming conditions No. 6 in Comparative Example 2 is from 1.10 or more to less than 1.15.

C: The ratio of irradiation energy to the irradiation energy for the electrophotographic photosensitive member produced under the film forming conditions No. 6 in Comparative Example 2 is 1.15 or more.

Evaluation of $sp^3$ Content

To evaluate the $sp^3$ content, a sample prepared by cutting out the electrophotographic photosensitive member in a square shape of 10 mm square at a middle portion thereof in its lengthwise direction at its arbitrary position in peripheral direction was measured with a laser Raman spectrophotometer (NRS-2000, manufactured by JASCO Corporation).

As specific conditions, it was measured under a light source: an $Ar^+$ laser of 514.5 nm, a laser intensity: 20 mA, and an objective lens: 50 magnifications, and was measured three times at a central wavelength of 1,380 $cm^{-1}$, for an exposure time of 30 seconds and making integration five times. Also, the Raman spectra obtained were analyzed in the following way. That is, the peak wave number of a shoulder Raman band was fixed at 1,390 $cm^{-1}$, and the wave number of a main Raman band was set at 1,480 $cm^{-1}$ and did not fixed there, where curve fitting was made using Gaussian distribution. Here, the base line was set by linear approximation. The value of $I_D/I_G$ was found from peak intensity $I_G$ of the main Raman band and peak intensity $I_D$ of the shoulder Raman band which were obtained by the curve fitting, and an average value of the values for three times was used to evaluate the $sp^3$ content.

Measurement of Surface Roughness

About two electrophotographic photosensitive members, these were measured at middle portions thereof in their lengthwise direction at arbitrary positions in peripheral direction, using an atomic force microscope (AFM) (Q-SCOPE 250, Version 3.181, manufactured by Quesant Instrument Corporation), and the values of Ra and Δa were calculated. An average value of values of Ra and Δa thus found was taken as the values of Ra and Δa.

Stated specifically, these were measured by actuating "Wavemade", using a head: Tape 10, and a probe: NSC16, and under measuring conditions of scan rate: 4 Hz in the range of 10 μm×10 μm, integral gain: 600, proportional gain: 500, and scan resolution: 300. AFM observation images obtained by Q-SCOPE 250, manufactured by Quesant Instrument Corporation, were corrected using its analytical software by actuating "Parabolic Line by Line" of "Tilt Removal". The AFM observation images thus corrected were processed by histogram analysis to calculate the values of Ra and Δa. However, as the Ra found by histogram analysis, the value indicated by "Means. Deviation" was used.

About Example 1 and Comparative Examples 1 and 2, the results concerning the C/(Si+C), Si atom density, C atom density, Si+C atom density, H/(Si+C+H), H atom density, $sp^3$ content, high-humidity image flow 1, wear resistance, gradation and sensitivity are shown together in Table 5.

TABLE 5

| | Film forming conditions No. | C/(Si + C) | Si atom density ($10^{22}$ atom/$cm^3$) | C atom density ($10^{22}$ atom/$cm^3$) | Si + C atom density ($10^{22}$ atom/$cm^3$) | H/(Si + C + H) | H atom density ($10^{22}$ atom/$cm^3$) | $sp^3$ content | High = humidity image flow 1 | Wear resistance | Gradation | Sensitivity |
|---|---|---|---|---|---|---|---|---|---|---|---|---|
| Cp. 2 | 6 | 0.70 | 1.91 | 4.45 | 6.35 | 0.39 | 4.06 | 0.73 | F | F | A | A |
| Cp. 1 | 5 | 0.74 | 1.68 | 4.80 | 6.48 | 0.45 | 5.30 | 0.69 | E | E | A | A |
| Ex. 1 | 1 | 0.75 | 1.65 | 4.95 | 6.60 | 0.43 | 4.98 | 0.69 | B | B | A | A |
| | 2 | 0.73 | 1.81 | 4.88 | 6.69 | 0.44 | 5.26 | 0.67 | B | B | A | A |
| | 3 | 0.73 | 1.84 | 4.97 | 6.81 | 0.41 | 4.73 | 0.62 | A | A | A | A |
| | 4 | 0.72 | 1.93 | 4.97 | 6.90 | 0.41 | 4.79 | 0.70 | A | A | A | A |

Cp.: Comparative Example; Ex.: Example

From the results shown in Table 5, it is seen that setting the Si+C atom density in the surface layer at $6.60\times10^{22}$atom/cm$^3$ or more brings improvements in high-humidity image flow resistance and wear resistance. It is also seen that setting the Si+C atom density in the surface layer at $6.81\times10^{22}$atom/cm$^3$ or more brings further improvements in high-humidity image flow resistance and wear resistance.

It is still also seen that, since the high-humidity image flow resistance is improved without using any photosensitive member heater, an electrophotographic photosensitive member good for energy saving as well can be obtained inasmuch as the Si+C atom density in the surface layer is set within the above range.

The electrophotographic photosensitive members produced in Example 1 and Comparative Examples 1 and 2 had surface roughness in the ranges of from 32 nm to 36 nm as Ra, and from 0.13 to 0.16 as Δa.

Further, in regard to the surface layer formed under the film forming conditions No. 2 in Example 1 and the surface layer formed under the film forming conditions No. 6 in Comparative Example 2, their spectra of X-ray absorption fine structure (XAFS) were measured to analyze extended X-ray absorption fine structure (EXAFS). As the result, the distance between Si—C bonds that was obtained from a radius distribution function calculated from a vibration component of SiK-edge EXAFS was 0.172 nm under the film forming conditions No. 2 in Example 1 and 0.184 nm under the film forming conditions No. 6 in Comparative Example 2. From these facts, it is ascertained that the interatomic distance of Si—C bonds is made shorter by making higher the Si+C atom density in the surface layer.

Example 2

Like Example 1, using the plasma-assisted processing system shown in FIG. 2, making use of a high-frequency power source having an RF band as a frequency band, layers were formed on the cylindrical substrate to produce positive-charging a-Si electrophotographic photosensitive members. Here, the layers were formed in the order of the charge injection preventing layer, the photoconductive layer and the surface layer under conditions shown in Table 1 above, and the high-frequency power, $SiH_4$ flow rate and $CH_4$ flow rate in forming the surface layer were set under conditions shown in Table 6 below.

TABLE 6

| Film forming conditions No. | 7 | 8 | 9 | 10 | 11 | 13 |
|---|---|---|---|---|---|---|
| $SiH_4$ [mL/min(normal)] | 35 | 26 | 26 | 26 | 26 | 26 |
| $CH_4$ [ml/min(normal)] | 190 | 150 | 190 | 400 | 360 | 400 |
| High-frequency power (W) | 750 | 700 | 700 | 800 | 850 | 900 |

About the electrophotographic photosensitive members produced in Example 2, the values of surface roughness were calculated and thereafter the C/(Si+C), the Si atom density, the C atom density, the Si+C atom density, the H/(Si+C+H), the H atom density and the sp$^3$ content were determined all in the same way as in Example 1. Evaluation was also made on the high-humidity image flow 1, wear resistance, gradation and sensitivity in the same way as in Example 1. Results obtained on these are shown in Table 8.

Comparative Example 3

Like Example 2, using the plasma-assisted processing system shown in FIG. 2, making use of a high-frequency power source having an RF band as a frequency band, the like layers were formed on the cylindrical substrate under conditions shown in Table 1 above, to produce positive-charging a-Si electrophotographic photosensitive members. The high-frequency power, $SiH_4$ flow rate and $CH_4$ flow rate in forming the surface layer were set under conditions shown in Table 7 below.

TABLE 7

| Film forming conditions No. | 14 | 15 |
|---|---|---|
| $SiH_4$ [mL/min(normal)] | 35 | 26 |
| $CH_4$ [ml/min(normal)] | 190 | 450 |
| High-frequency power (W) | 700 | 950 |

About the electrophotographic photosensitive members produced in Comparative Example 3, the values of surface roughness were calculated and thereafter the C/(Si+C), the Si atom density, the C atom density, the Si+C atom density, the H/(Si+C+H), the H atom density and the sp$^3$ content were determined all in the same way as in Example 1. Evaluation was also made on the high-humidity image flow 1, wear resistance, gradation and sensitivity in the same way as in Example 1. Results obtained on these are shown in Table 8.

About Example 2 and Comparative Example 3, the results concerning the C/(Si+C), Si atom density, C atom density, Si+C atom density, H/(Si+C+H), H atom density, sp$^3$ content, high-humidity image flow 1, wear resistance, gradation and sensitivity are shown together in Table 8.

TABLE 8

| | Film forming conditions No. | C/(Si + C) | Si atom density ($10^{22}$ atom/cm$^3$) | C atom density ($10^{22}$ atom/cm$^3$) | Si + C atom density ($10^{22}$ atom/cm$^3$) | H/(Si + C + H) | H atom density ($10^{22}$ atom/cm$^3$) | sp$^3$ content | High = humidity image flow 1 | Wear resistance | Gradation | Sensitivity |
|---|---|---|---|---|---|---|---|---|---|---|---|---|
| Cp. 3 | 14 | 0.59 | 3.12 | 4.49 | 7.61 | 0.32 | 3.58 | 0.54 | A | A | B | A |
| Ex. 2 | 7 | 0.61 | 2.99 | 4.68 | 7.67 | 0.31 | 3.45 | 0.40 | A | A | A | A |
| | 8 | 0.63 | 2.90 | 4.94 | 7.84 | 0.30 | 3.36 | 0.50 | A | A | A | A |
| | 9 | 0.65 | 2.68 | 4.99 | 7.67 | 0.31 | 3.45 | 0.58 | A | A | A | A |
| | 10 | 0.73 | 1.85 | 5.02 | 6.87 | 0.40 | 4.58 | 0.63 | A | A | A | A |
| | 11 | 0.74 | 1.87 | 5.31 | 7.18 | 0.35 | 3.87 | 0.60 | A | A | A | A |
| | 13 | 0.75 | 1.79 | 5.37 | 7.16 | 0.36 | 4.03 | 0.63 | A | A | A | A |
| Cp. 3 | 15 | 0.76 | 1.74 | 5.49 | 7.23 | 0.34 | 3.72 | 0.66 | A | A | A | C |

Cp.: Comparative Example; Ex.: Example

From the results shown in Table 8, it is seen that setting the Si+C atom density in the surface layer at $6.60\times10^{22}$atom/cm$^3$ or more and, in addition thereto, setting the C/(Si+C) therein at 0.61 or more bring an improvement in gradation. It is also seen that setting the Si+C atom density in the surface layer at $6.60\times10^{22}$atom/cm$^3$ or more and, in addition thereto, setting the C/(Si+C) at 0.75 or less keep light absorption from increasing, and bring an improvement in sensitivity.

The electrophotographic photosensitive members produced in Example 2 and Comparative Example 3 had surface roughness in the ranges of from 32 nm to 36 nm as Ra, and from 0.13 to 0.16 as Δa.

Example 3

Like Example 1, using the plasma-assisted processing system shown in FIG. 2, making use of a high-frequency power source having an RF band as a frequency band, layers were formed on the cylindrical substrate to produce positive-charging a-Si electrophotographic photosensitive members. Here, the layers were formed in the order of the charge injection preventing layer, the photoconductive layer and the surface layer under conditions shown in Table 1 above, and the high-frequency power, $SiH_4$ flow rate and $CH_4$ flow rate in forming the surface layer were set under conditions shown in Table 9 below.

TABLE 9

| Film forming Conditions No. | 16 | 17 | 18 | 19 | 20 | 21 | 22 | 23 | 24 |
|---|---|---|---|---|---|---|---|---|---|
| $SiH_4$ [mL/min(normal)] | 26 | 26 | 32 | 26 | 26 | 26 | 26 | 26 | 26 |
| $CH_4$ [ml/min(normal)] | 150 | 260 | 260 | 190 | 260 | 360 | 360 | 320 | 400 |
| High-frequency power (W) | 750 | 850 | 850 | 750 | 750 | 650 | 600 | 550 | 650 |

About the electrophotographic photosensitive members produced in Example 3, the values of surface roughness were calculated and thereafter the C/(Si+C), the Si atom density, the C atom density, the Si+C atom density, the H/(Si+C+H), the H atom density and the sp$^3$ content were determined all in the same way as in Example 1. Evaluation was also made on the high-humidity image flow 1, wear resistance, gradation and sensitivity in the same way as in Example 1. Results obtained on these are shown in Table 10 together with those obtained under the film forming conditions No. 9 in Example 2.

TABLE 10

| | Film forming conditions No. | C/(Si + C) | Si atom density ($10^{22}$ atom/cm$^3$) | C atom density ($10^{22}$ atom/cm$^3$) | Si + C atom density ($10^{22}$ atom/cm$^3$) | H/(Si + C + H) | H atom density ($10^{22}$ atom/cm$^3$) | sp$^3$ content | High = humidity image flow 1 | Wear resistance | Gradation | Sensitivity |
|---|---|---|---|---|---|---|---|---|---|---|---|---|
| Ex. 3 | 16 | 0.65 | 2.78 | 5.15 | 7.93 | 0.28 | 3.08 | 0.34 | A | A | A | B |
| | 17 | 0.71 | 2.19 | 5.37 | 7.56 | 0.29 | 3.09 | 0.41 | A | A | A | B |
| | 18 | 0.67 | 2.48 | 5.04 | 7.52 | 0.30 | 3.22 | 0.31 | A | A | A | A |
| | 19 | 0.67 | 2.55 | 5.18 | 7.73 | 0.30 | 3.31 | 0.42 | A | A | A | A |
| Ex. 2 | 9 | 0.65 | 2.68 | 4.99 | 7.67 | 0.31 | 3.45 | 0.58 | A | A | A | A |
| Ex. 3 | 20 | 0.70 | 2.23 | 5.20 | 7.43 | 0.33 | 3.66 | 0.49 | A | A | A | A |
| | 21 | 0.71 | 1.96 | 4.81 | 6.77 | 0.42 | 4.90 | 0.78 | C | C | A | A |
| | 22 | 0.70 | 2.00 | 4.66 | 6.65 | 0.44 | 5.23 | 0.89 | C | C | A | A |
| | 23 | 0.68 | 2.14 | 4.54 | 6.68 | 0.45 | 5.47 | 0.96 | C | C | A | A |
| | 24 | 0.72 | 1.86 | 4.77 | 6.63 | 0.46 | 5.65 | 0.74 | D | D | A | A |

Ex.: Example

From the results shown in Table 10, it is seen that setting the H/(Si+C+H) in the surface layer at 0.30 or more keeps light absorption from increasing and hence brings an improvement in sensitivity. It is also seen that setting the H/(Si+C+H) in the surface layer at 0.45 or less brings further improvements in high-humidity image flow resistance and wear resistance.

It is still also seen that, since the high-humidity image flow resistance is improved without using any photosensitive member heater, an electrophotographic photosensitive member good for energy saving as well can be obtained inasmuch as the H/(Si+C+H) in the surface layer is set within the above range (from 0.30 or more to 0.45 or less).

The electrophotographic photosensitive members produced in Example 3 had surface roughness in the ranges of from 32 nm to 36 nm as Ra, and from 0.13 to 0.16 as Δa.

Example 4

Like Example 1, using the plasma-assisted processing system shown in FIG. 2, making use of a high-frequency power source having an RF band as a frequency band, layers were formed on the cylindrical substrate to produce positive-charging a-Si electrophotographic photosensitive members. Here, the layers were formed in the order of the charge injection preventing layer, the photoconductive layer and the surface layer under conditions shown in Table 1 above, and the high-frequency power, $SiH_4$ flow rate and $CH_4$ flow rate in forming the surface layer were set under conditions shown in Table 11 below.

TABLE 11

| Film forming Conditions No. | 25 | 26 | 27 | 28 | 29 | 30 | 31 |
|---|---|---|---|---|---|---|---|
| $SiH_4$ [mL/min(normal)] | 26 | 26 | 26 | 26 | 26 | 26 | 26 |
| $CH_4$ [ml/min(normal)] | 150 | 150 | 190 | 190 | 320 | 320 | 300 |
| High-frequency power (W) | 850 | 800 | 850 | 800 | 700 | 650 | 600 |

About the electrophotographic photosensitive members produced in Example 4, the values of surface roughness were calculated and thereafter the C/(Si+C), the Si atom density, the C atom density, the Si+C atom density, the H/(Si+C+H), the H atom density and the $sp^3$ content were determined all in the same way as in Example 1. Evaluation was also made on the high-humidity image flow 1, wear resistance, gradation and sensitivity in the same way as in Example 1. Results obtained on these in Example 4 are shown in Table 12 together with those obtained under the film forming conditions No. 4 in Example 1 and the film forming conditions Nos. 8 and 10 in Example 2.

TABLE 12

| | Film forming conditions No. | C/(Si + C) | Si atom density ($10^{22}$ atom/cm$^3$) | C atom density ($10^{22}$ atom/cm$^3$) | Si + C atom density ($10^{22}$ atom/cm$^3$) | H/(Si + C + H) | H atom density ($10^{22}$ atom/cm$^3$) | $sp^3$ content | High = humidity image flow 1 | Wear resistance | Gradation | Sensitivity |
|---|---|---|---|---|---|---|---|---|---|---|---|---|
| Ex. 4 | 25 | 0.67 | 2.63 | 5.35 | 7.98 | 0.25 | 2.66 | 0.20 | A | A | A | B |
| | 26 | 0.66 | 2.70 | 5.24 | 7.94 | 0.27 | 2.94 | 0.25 | A | A | A | B |
| | 27 | 0.68 | 2.51 | 5.33 | 7.84 | 0.27 | 2.90 | 0.30 | A | A | A | B |
| | 28 | 0.67 | 2.57 | 5.22 | 7.79 | 0.29 | 3.18 | 0.33 | A | A | A | B |
| Ex. 2 | 8 | 0.63 | 2.90 | 4.94 | 7.84 | 0.30 | 3.36 | 0.50 | A | A | A | A |
| | 10 | 0.73 | 1.85 | 5.02 | 6.87 | 0.40 | 4.58 | 0.63 | A | A | A | A |
| Ex. 4 | 29 | 0.71 | 2.04 | 5.00 | 7.04 | 0.39 | 4.50 | 0.63 | A | A | A | A |
| Ex. 1 | 4 | 0.72 | 1.93 | 4.97 | 6.90 | 0.41 | 4.79 | 0.70 | A | A | A | A |
| Ex. 4 | 30 | 0.70 | 2.09 | 4.87 | 6.96 | 0.41 | 4.84 | 0.72 | B | B | A | A |
| | 31 | 0.68 | 2.22 | 4.71 | 6.93 | 0.42 | 5.02 | 0.86 | B | B | A | A |

Ex.: Example

From the results shown in Table 12, it is seen that setting the $sp^3$ content in the surface layer at 0.70 or less brings further improvements in high-humidity image flow resistance and wear resistance. Then, it is seen that setting the $sp^3$ content in the surface layer at 0.20 or more brings further improvements in high-humidity image flow resistance and wear resistance.

It is still also seen that, since the high-humidity image flow resistance is improved without using any photosensitive member heater, an electrophotographic photosensitive member good for energy saving as well can be obtained inasmuch as the Si+C atom density in the surface layer is set within the above range.

Comparative Example 4

Like Example 1, using the plasma-assisted processing system shown in FIG. 2, making use of a high-frequency power source having an RF band as a frequency band, layers were formed on the cylindrical substrate to produce positive-charging a-Si electrophotographic photosensitive members. Here, the layers were formed in the order of the charge injection preventing layer, the photoconductive layer and the surface layer under conditions shown in Table 1 above, and the high-frequency power, $SiH_4$ flow rate and $CH_4$ flow rate in forming the surface layer were set under conditions shown in Table 13 below.

TABLE 13

| Film forming Conditions No. | 32 | 33 | 35 | 36 |
|---|---|---|---|---|
| $SiH_4$ [mL/min(normal)] | 26 | 26 | 20 | 20 |
| $CH_4$ [ml/min(normal)] | 360 | 360 | 600 | 600 |
| High-frequency power (W) | 550 | 1,000 | 750 | 850 |

About the electrophotographic photosensitive members produced in Comparative Example 4, the values of surface roughness were calculated and thereafter the C/(Si+C), the Si atom density, the C atom density, the Si+C atom density, the H/(Si+C+H), the H atom density and the $sp^3$ content were determined all in the same way as in Example 1. Evaluation was also made on the high-humidity image flow 1, wear resistance, gradation and sensitivity in the same way as in Example 1. Results obtained on these are shown in Table 14 together with those obtained under the film forming conditions No. 4 in Example 1, the film forming conditions No. 11 in Example 2 and the film forming conditions Nos. 21 and 22 in Example 3.

TABLE 14

| | Film forming conditions No. | C/(Si + C) | Si atom density ($10^{22}$ atom/cm$^3$) | C atom density ($10^{22}$ atom/cm$^3$) | Si + C atom density ($10^{22}$ atom/cm$^3$) | H/(Si + C + H) | H atom density ($10^{22}$ atom/cm$^3$) | $sp^3$ content | High = humidity image flow 1 | Wear resistance | Gradation | Sensitivity |
|---|---|---|---|---|---|---|---|---|---|---|---|---|
| Cp. 4 | 32 | 0.69 | 2.02 | 4.49 | 6.50 | 0.46 | 5.54 | 0.96 | E | E | A | A |
| Ex. 3 | 22 | 0.70 | 2.00 | 4.66 | 6.65 | 0.44 | 5.23 | 0.89 | C | C | A | A |
| | 21 | 0.71 | 1.96 | 4.81 | 6.77 | 0.42 | 4.90 | 0.78 | C | C | A | A |
| Ex. 1 | 4 | 0.72 | 1.93 | 4.97 | 6.90 | 0.41 | 4.79 | 0.70 | A | A | A | A |
| Ex. 2 | 11 | 0.74 | 1.87 | 5.31 | 7.18 | 0.35 | 3.87 | 0.60 | A | A | A | A |
| Cp. 4 | 33 | 0.76 | 1.78 | 5.64 | 7.42 | 0.29 | 3.03 | 0.67 | A | A | A | C |
| | 35 | 0.77 | 1.45 | 4.85 | 6.30 | 0.46 | 5.37 | 0.75 | F | F | A | C |
| | 36 | 0.79 | 1.37 | 5.15 | 6.52 | 0.44 | 5.12 | 0.77 | E | E | A | C |

Cp.: Comparative Example; Ex.: Example

From the results shown in Table 14, it is seen that setting the Si+C atom density in the surface layer at $6.60\times10^{22}$atom/cm$^3$ or more and also setting the C/(Si+C) therein at from 0.61 or more to 0.75 or less enable electrophotographic photosensitive members to be obtained which have superior high-humidity image flow resistance, wear resistance, gradation and sensitivity.

It is also seen that setting the H/(Si+C+H) at from 0.30 or more to 0.45 or less enables electrophotographic photosensitive members to be obtained which have much superior high-humidity image flow resistance, wear resistance and sensitivity.

It is still also seen that setting the $sp^3$ content at from 0.20 or more to 0.70 or less enables electrophotographic photosensitive members to be obtained which have much superior wear resistance.

The electrophotographic photosensitive members produced in Example 4 and Comparative Example 4 had surface roughness in the ranges of from 32 nm to 36 nm as Ra, and from 0.13 to 0.16 as Δa.

Example 5

Like Example 1, using the plasma-assisted processing system shown in FIG. 2, making use of a high-frequency power source having an RF band as a frequency band, layers were formed on the cylindrical substrate to produce positive-charging a-Si electrophotographic photosensitive members. Here, the layers were formed in the order of the charge injection preventing layer, the photoconductive layer and the surface layer under conditions shown in Table 1 above, and the high-frequency power, $SiH_4$ flow rate and $CH_4$ flow rate in forming the surface layer were set under conditions shown in Table 15 below.

TABLE 15

| Film forming conditions No. | 37 | 38 |
|---|---|---|
| $SiH_4$ [mL/min(normal)] | 32 | 35 |
| $CH_4$ [ml/min(normal)] | 260 | 190 |
| High-frequency power (W) | 650 | 900 |

About the electrophotographic photosensitive members produced in Example 5, the values of surface roughness were calculated and thereafter the C/(Si+C), the Si atom density, the C atom density, the Si+C atom density, the H/(Si+C+H), the H atom density and the $sp^3$ content were determined all in the same way as in Example 1. Evaluation was also made on the high-humidity image flow 1, wear resistance, gradation and sensitivity in the same way as in Example 1. Results obtained on these are shown in Table 17.

Comparative Example 5

Like Example 1, using the plasma-assisted processing system shown in FIG. 2, making use of a high-frequency power source having an RF band as a frequency band, layers were formed on the cylindrical substrate to produce positive-charging a-Si electrophotographic photosensitive members. Here, the layers were formed in the order of the charge injection preventing layer, the photoconductive layer and the surface layer under conditions shown in Table 1 above, and the high-frequency power, $SiH_4$ flow rate and $CH_4$ flow rate in forming the surface layer were set under conditions shown in Table 16 below.

TABLE 16

| Film forming conditions No. | 39 | 40 | 41 |
|---|---|---|---|
| $SiH_4$ [mL/min(normal)] | 26 | 32 | 35 |
| $CH_4$ [ml/min(normal)] | 260 | 260 | 190 |
| High-frequency power (W) | 400 | 450 | 550 |

About the electrophotographic photosensitive members produced in Comparative Example 5, the values of surface roughness were calculated and thereafter the C/(Si+C), the Si atom density, the C atom density, the Si+C atom density, the H/(Si+C+H), the H atom density and the $sp^3$ content were determined all in the same way as in Example 1. Evaluation was also made on the high-humidity image flow 1, wear resistance, gradation and sensitivity in the same way as in Example 1. Results obtained on these are shown in Table 17.

About Example 5 and Comparative Example 5, the results concerning the C/(Si+C), Si atom density, C atom density, Si+C atom density, H/(Si+C+H), H atom density, $sp^3$ content, high-humidity image flow 1, wear resistance, gradation and sensitivity are shown in Table 17 together with those obtained under the film forming conditions No. 7 in Example 2, the film forming conditions No. 14 in Comparative Example 3 and the film forming conditions Nos. 17, 18 and 20 in Example 3.

TABLE 17

| | Film forming conditions No. | C/(Si + C) | Si atom density ($10^{22}$ atom/cm$^3$) | C atom density ($10^{22}$ atom/cm$^3$) | Si + C atom density ($10^{22}$ atom/cm$^3$) | H/(Si + C + H) | H atom density ($10^{22}$ atom/cm$^3$) | $sp^3$ content | High = humidity image flow 1 | Wear resistance | Gradation | Sensitivity |
|---|---|---|---|---|---|---|---|---|---|---|---|---|
| Cp. 5 | 39 | 0.63 | 2.42 | 4.12 | 6.54 | 0.49 | 6.28 | 1.46 | E | E | A | A |
| Ex. 3 | 20 | 0.70 | 2.23 | 5.20 | 7.43 | 0.33 | 3.66 | 0.49 | A | A | A | A |
| | 17 | 0.71 | 2.19 | 5.37 | 7.56 | 0.29 | 3.09 | 0.41 | A | A | A | B |
| Cp. 5 | 40 | 0.60 | 2.68 | 4.02 | 6.70 | 0.44 | 5.26 | 1.27 | C | C | B | A |
| Ex. 5 | 37 | 0.64 | 2.61 | 4.64 | 7.25 | 0.38 | 4.44 | 0.69 | A | A | A | A |
| Ex. 3 | 18 | 0.67 | 2.48 | 5.04 | 7.52 | 0.30 | 3.22 | 0.31 | A | A | A | A |
| Cp. 5 | 41 | 0.56 | 3.21 | 4.09 | 7.30 | 0.39 | 4.67 | 1.80 | B | B | B | A |
| Cp. 3 | 14 | 0.59 | 3.12 | 4.49 | 7.61 | 0.32 | 3.58 | 0.54 | A | A | B | A |
| Ex. 2 | 7 | 0.61 | 2.99 | 4.68 | 7.67 | 0.31 | 3.45 | 0.40 | A | A | A | A |
| Ex. 5 | 38 | 0.64 | 2.83 | 5.03 | 7.86 | 0.27 | 2.91 | 0.21 | A | A | A | B |

Cp.: Comparative Example; Ex.: Example

From the results shown in Table 17, it is seen that setting the Si+C atom density in the surface layer at $6.60\times10^{22}$atom/cm$^3$ or more and also setting the C/(Si+C) therein at from 0.61 or more to 0.75 or less enable electrophotographic photosensitive members to be obtained which have superior high-humidity image flow resistance, wear resistance, gradation and sensitivity.

It is also seen that setting the H/(Si+C+H) at from 0.30 or more to 0.45 or less enables electrophotographic photosensitive members to be obtained which have much superior high-humidity image flow resistance, wear resistance and sensitivity.

It is still also seen that setting the $sp^3$ content at from 0.20 or more to 0.70 or less enables electrophotographic photosensitive members to be obtained which have much superior wear resistance.

The electrophotographic photosensitive members produced in Example 5 and Comparative Example 5 had surface roughness in the ranges of from 32 nm to 36 nm as Ra, and from 0.13 to 0.16 as Δa.

Comparative Example 6

Like Example 1, using the plasma-assisted processing system shown in FIG. 2, making use of a high-frequency power source having an RF band as a frequency band, layers were formed on the cylindrical substrate to produce positive-charging a-Si electrophotographic photosensitive members. Here, the layers were formed in the order of the charge injection preventing layer, the photoconductive layer and the surface layer under conditions shown in Table 1 above, and the high-frequency power, $SiH_4$ flow rate and $CH_4$ flow rate in forming the surface layer were set under conditions shown in Table 18 below.

TABLE 18

| Film forming conditions No. | 42 |
|---|---|
| $SiH_4$ [mL/min(normal)] | 26 |
| $CH_4$ [ml/min(normal)] | 700 |
| High-frequency power (W) | 800 |

About the electrophotographic photosensitive members produced in Comparative Example 6, the values of surface roughness were calculated and thereafter the C/(Si+C), the Si atom density, the C atom density, the Si+C atom density, the H/(Si+C+H), the H atom density and the $sp^3$ content were determined all in the same way as in Example 1. Evaluation was also made on the high-humidity image flow 1, wear resistance, gradation and sensitivity in the same way as in Example 1. Results obtained on these are shown in Table 19 together with those obtained under the film forming conditions No. 1 in Example 1, the film forming conditions No. 10 in Example 2 and the film forming conditions Nos. 26 and 28 in Example 4.

TABLE 19

| | Film forming conditions No. | C/(Si + C) | Si atom density ($10^{22}$ atom/cm$^3$) | C atom density ($10^{22}$ atom/cm$^3$) | Si + C atom density ($10^{22}$ atom/cm$^3$) | H/(Si + C + H) | H atom density ($10^{22}$ atom/cm$^3$) | $sp^3$ content | High = humidity image flow 1 | Wear resistance | Gradation | Sensitivity |
|---|---|---|---|---|---|---|---|---|---|---|---|---|
| Cp. 6 | 42 | 0.77 | 1.41 | 4.70 | 6.11 | 0.48 | 5.64 | 0.78 | F | F | A | C |
| Ex. 1 | 1 | 0.75 | 1.65 | 4.95 | 6.60 | 0.43 | 4.98 | 0.69 | B | B | A | A |
| Ex. 2 | 10 | 0.73 | 1.85 | 5.02 | 6.87 | 0.40 | 4.58 | 0.63 | A | A | A | A |
| Ex. 4 | 28 | 0.67 | 2.57 | 5.22 | 7.79 | 0.29 | 3.18 | 0.33 | A | A | A | B |
| | 26 | 0.66 | 2.70 | 5.24 | 7.94 | 0.27 | 2.94 | 0.25 | A | A | A | B |

Cp.: Comparative Example; Ex.: Example

From the results shown in Table 19, it is seen that setting the Si+C atom density in the surface layer at $6.60\times10^{22}$atom/cm$^3$ or more and also setting the C/(Si+C) therein at from 0.61 or more to 0.75 or less enable electrophotographic photosensitive members to be obtained which have superior high-humidity image flow resistance, wear resistance, gradation and sensitivity.

It is also seen that setting the H/(Si+C+H) at from 0.30 or more to 0.45 or less enables electrophotographic photosensitive members to be obtained which have much superior high-humidity image flow resistance, wear resistance and sensitivity.

It is still also seen that setting the $sp^3$ content at from 0.20 or more to 0.70 or less enables electrophotographic photosensitive members to be obtained which have much superior wear resistance.

The electrophotographic photosensitive members produced in Comparative Example 6 had surface roughness in the ranges of from 32 nm to 36 nm as Ra, and from 0.13 to 0.16 as Δa.

Example 6

Using the electrophotographic photosensitive member produced under the film forming conditions No. 4 in Example 1, evaluation on the high-humidity image flow was made by evaluation 2 on high-humidity image flow and evaluation 3 on high-humidity image flow shown below. Results obtained are shown in Table 20.

Comparative Example 7

Using the electrophotographic photosensitive member produced under the film forming conditions No. 6 in Comparative Example 2, evaluation on the high-humidity image flow was made by evaluation 2 on high-humidity image flow and evaluation 3 on high-humidity image flow in the same way as in Example 6. Results obtained are shown in Table 20.

Evaluation 2 on High-Humidity Image Flow

As an electrophotographic apparatus used in the evaluation 2 on high-humidity image flow, an electrophotographic apparatus was readied which was basically the electrophotographic apparatus "iR-5065" (trade name), manufactured by CANON INC., set up as shown in FIG. 4, and from which an air fan for primary charging means was removed for the purpose of experiment.

The electrophotographic photosensitive members produced were each set in the above electrophotographic apparatus, and an A3-size character chart (4 pt, print percentage: 4%) was reproduced before a continuous paper feed test in a high-humidity environment of temperature 30° C. and relative humidity 80% (volumetric absolute humidity: 24.3 g/cm$^3$). At this stage, this was conducted under conditions where a photosensitive member heater was kept in the on state.

After images were reproduced before a continuous paper feed test, the continuous paper feed test was conducted. When the continuous paper feed test was conducted, it was conducted under continuous paper feed test conditions where the photosensitive member heater was kept in the off state during both the time that the electrophotographic apparatus stood operated to conduct the continuous paper feed test and the time that the electrophotographic apparatus stood stopped.

Stated specifically, using a test pattern with a print percentage of 1%, a continuous paper feed test on 25,000 sheets per day was conducted for 10 days to conduct a continuous paper feed test on up to 250,000 sheets. Thereafter, an A3-size character chart (4 pt, print percentage: 4%) was reproduced after the continuous paper feed test was finished. After the images were thus reproduced, the electrophotographic apparatus was stopped in the state the photosensitive member heater was kept in the off state, and this was left to stand for 15 hours.

After 15 hours, the electrophotographic apparatus was started to operate while the photosensitive member heater was kept in the off state, and the A3-size character chart (4 pt, print percentage: 4%) was reproduced. The images reproduced before the continuous paper feed test and the images reproduced after leaving for 15 hours after the continuous paper feed test were each made electronic into a PDF (portable document file) under binary conditions of monochromatic 300 dpi by using a digital electrophotographic apparatus "iRC-5870" (trade name), manufactured by CANON INC.

Then, the images having been made electronic were processed by using an image editing software ADOBE PHOTOSHOP (trade name), available from Adobe Systems Incorporated, to measure their black percentage in image areas corresponding to the places where the electrophotographic photosensitive member stood faced the primary charging assembly 6002, the transfer charging assembly 6004 and the separation charging assembly 6005, in respect of the images reproduced after leaving for 15 hours after the continuous paper feed test. Their black percentage was also measured in image areas corresponding to the places where the electrophotographic photosensitive member did not stand faced the above charging assemblies. The like measurement of black percentage was also made on images reproduced before the continuous paper feed test. Then, the proportion of the black percentage of images reproduced after leaving for 15 hours after the continuous paper feed test to the black percentage of images reproduced before the continuous paper feed test was found to make evaluation on the high-humidity image flow.

In this evaluation, the proportion of the black percentage in image areas corresponding to the places where the electrophotographic photosensitive member stood faced the charging assemblies concerns the evaluation on the image flow below charger, and the proportion of the black percentage in image areas corresponding to the places where the electrophotographic photosensitive member did not stand faced the charging assemblies concerns the evaluation on the image flow during running.

Where the image flow below charger and image flow during running have occurred, blurred characters or letters are formed over the whole images, or characters or letters are not printed to cause blank areas in images. Hence, when compared with images formed before the continuous paper feed test, the images reproduced have a lower black percentage. Thus, it follows that, the closer to 100% the proportion of black percentage of the images reproduced after leaving for 15 hours after the continuous paper feed test to black percentage of the images before the continuous paper feed test is, the better the high-humidity image flow is prevented. Incidentally, for the evaluation 2 on high-humidity image flow, the effect to be brought by the present invention is judged to have been obtained when evaluated as "D" or higher.

A: The proportion of black percentage of the images reproduced after leaving for 15 hours after the continuous paper feed test to black percentage of the images before the continuous paper feed test is from 95% or more to 105% or less.

B: The proportion of black percentage of the images reproduced after leaving for 15 hours after the continuous paper feed test to black percentage of the images before the continuous paper feed test is from 90% or more to less than 95%.

C: The proportion of black percentage of the images reproduced after leaving for 15 hours after the continuous paper feed test to black percentage of the images before the continuous paper feed test is from 85% or more to less than 90%.

D: The proportion of black percentage of the images reproduced after leaving for 15 hours after the continuous paper feed test to black percentage of the images before the continuous paper feed test is from 80% or more to less than 85%.

E: The proportion of black percentage of the images reproduced after leaving for 15 hours after the continuous paper feed test to black percentage of the images before the continuous paper feed test is from 70% or more to less than 80%.

F: The proportion of black percentage of the images reproduced after leaving for 15 hours after the continuous paper feed test to black percentage of the normal images before the continuous paper feed test is less than 70%.

Evaluation 3 on High-Humidity Image Flow

As an electrophotographic apparatus used in the evaluation 3 on high-humidity image flow, an electrophotographic apparatus was readied which was basically the electrophotographic apparatus "iR-5065" (trade name), manufactured by CANON INC., set up as shown in FIG. 4, and from which an air fan for primary charging means was removed for the purpose of experiment. Further, its primary charging assembly 6002 was converted to the charging means set up as shown in FIG. 3A, and its transfer charging assembly 6004 and separation charging assembly 6005 were each converted to the charging means set up as shown in FIG. 3B. The shielding members 4103 and 4203 ere each made by using an aluminum thin sheet of 0.3 mm in sheet thickness.

The electrophotographic photosensitive members produced were each set in the above electrophotographic apparatus, and an A3-size character chart (4 pt, print percentage: 4%) was reproduced before a continuous paper feed test in a high-humidity environment of temperature 30° C. and relative humidity 80% (volumetric absolute humidity: 24.3 g/cm$^3$). At this stage, this was conducted under conditions where a photosensitive member heater was kept in the on state.

After images were reproduced before a continuous paper feed test, the continuous paper feed test was conducted. When the continuous paper feed test was conducted, the photosensitive member heater was kept in the off state during both the time that the electrophotographic apparatus stood operated to conduct the continuous paper feed test and the time that the electrophotographic apparatus stood stopped.

Stated specifically, using a test pattern with a print percentage of 1%, a continuous paper feed test on 25,000 sheets per day was conducted for 10 days to conduct a continuous paper feed test on up to 250,000 sheets. After this continuous paper feed test was finished, the electrophotographic apparatus was stopped while the photosensitive member heater was kept in the off state, where the shielding member 4103 was inserted between the primary charging assembly 6002 and the electrophotographic photosensitive member 6001. Also, the shielding member 4203 was inserted between the transfer charging assembly 6004 and separation charging assembly 6005 each and the electrophotographic photosensitive member 6001. The apparatus was left to stand for 15 hours in this state.

After 15 hours, the electrophotographic apparatus was started to operate while the photosensitive member heater was kept in the off state, and the A3-size character chart (4 pt, print percentage: 4%) was reproduced. The images reproduced before the continuous paper feed test and the images reproduced after leaving for 15 hours after the continuous paper feed test were each made electronic into a PDF (portable document file) under binary conditions of monochromatic 300 dpi by using a digital electrophotographic apparatus "iRC-5870" (trade name), manufactured by CANON INC.

Then, the images having been made electronic were processed by using an image editing software ADOBE PHOTOSHOP (trade name), available from Adobe Systems Incorporated, to measure their black percentage in image areas corresponding to the places where the electrophotographic photosensitive member stood faced the primary charging assembly 6002, the transfer charging assembly 6004 and the separation charging assembly 6005, in respect of the images reproduced after leaving for 15 hours after the continuous paper feed test. Their black percentage was also measured in image areas corresponding to the places where the electrophotographic photosensitive member did not stand faced the above charging assemblies. The like measurement of black percentage was also made on images reproduced before the continuous paper feed test. Then, the proportion of the black percentage of images reproduced after leaving for 15 hours after the continuous paper feed test to the black percentage of images reproduced before the continuous paper feed test was found to make evaluation on the high-humidity image flow.

In this evaluation, the proportion of the black percentage in image areas corresponding to the places where the electrophotographic photosensitive member stood faced the charging assemblies concerns the evaluation on the image flow below charger, and the proportion of the black percentage in image areas corresponding to the places where the electrophotographic photosensitive member did not stand faced the charging assemblies concerns the evaluation on the image flow during running.

Where the image flow below charger and image flow during running have occurred, blurred characters or letters are formed over the whole images, or characters or letters are not printed to cause blank areas in images. Hence, when compared with images formed before the continuous paper feed test, the images reproduced have a lower black percentage. Thus, it follows that, the closer to 100% the proportion of black percentage of the images reproduced after leaving for 15 hours after the continuous paper feed test to black percentage of the images before the continuous paper feed test is, the better the high-humidity image flow is prevented. Incidentally, for the evaluation 3 on high-humidity image flow, the effect to be brought by the present invention is judged to have been obtained when evaluated as "D" or higher.

A: The proportion of black percentage of the images reproduced after leaving for 15 hours after the continuous paper feed test to black percentage of the images before the continuous paper feed test is from 95% or more to 105% or less.

B: The proportion of black percentage of the images reproduced after leaving for 15 hours after the continuous paper feed test to black percentage of the images before the continuous paper feed test is from 90% or more to less than 95%.

C: The proportion of black percentage of the images reproduced after leaving for 15 hours after the continuous paper feed test to black percentage of the images before the continuous paper feed test is from 85% or more to less than 90%.

D: The proportion of black percentage of the images reproduced after leaving for 15 hours after the continuous paper feed test to black percentage of the images before the continuous paper feed test is from 80% or more to less than 85%.

E: The proportion of black percentage of the images reproduced after leaving for 15 hours after the continuous paper feed test to black percentage of the images before the continuous paper feed test is from 70% or more to less than 80%.

F: The proportion of black percentage of the images reproduced after leaving for 15 hours after the continuous paper feed test to black percentage of the normal images before the continuous paper feed test is less than 70%.

About Example 6 and Comparative Example 7, the results of evaluation on the high-humidity image flow 2 and high-humidity image flow 3 are shown in Table 20.

TABLE 20

| | | Evaluation 2 on high-humidity image flow | | Evaluation 3 on high-humidity image flow | |
|---|---|---|---|---|---|
| | Film forming conditions No. | Image flow below charger | Image flow during running | Image flow below charger | Image flow during running |
| Example 6 | 4 | B | A | A | A |
| Comp. Example 7 | 6 | F | E | E | E |

As is seen from the results shown in Table 20, in the a-SiC surface layer, even in a situation where the air fan for primary charging means was removed and, after image reproduction, charge products were present in a large quantity between the charging assemblies and the electrophotographic photosensitive member, the high-humidity image flow resistance was good against both the places standing faced the charging assemblies and the places not standing faced the same. It is seen from this fact that, in virtue of the a-SiC surface layer of the present invention, both the image flow below charger and the image flow during running can well be kept from occurring.

It is also seen that inserting the shielding members between the charging assembles after the continuous paper feed test was finished keeps charge products from adhering to the surface of the electrophotographic photosensitive member during stop of the electrophotographic apparatus, and hence the image flow below charger can much better be kept from occurring.

Example 7

Using as the conductive substrate 14 a cylinder of 84 mm in diameter, 381 mm in length and 3 mm in wall thickness, made of aluminum and the surface of which was mirror-finished, electrophotographic photosensitive members were produced by the procedure described above. In this Example, the electrophotographic photosensitive member 10 shown in FIG. 5B was employed, having the layer configuration of the lower-part charge injection preventing layer 15, the photoconductive layer 13, the intermediate layer 12 and the surface layer 11 on the substrate 14. The respective layers were formed under conditions shown in Table 21.

In Examples 7 to 13 and Comparative Examples 9 to 10 each, a cathode of 230 mm in inner diameter was used as the cathode 3111.

TABLE 21

| | Charge injecttion preventing layer | Photo-conduc-tive layer | Inter-mediate layer | Sur-face layer |
|---|---|---|---|---|
| Gases & gas flow rates: | | | | |
| $SiH_4$ [mL/min(normal)] | 350 | 450 | 26 | * |
| $H_2$ [mL/min(normal)] | 750 | 2,200 | — | — |
| $B_2H_6$ (ppm) (based on $SiH_4$) | 1,500 | 1 | — | — |
| NO [ml/min(normal)] | 10 | — | — | — |
| $CH_4$ [ml/min(normal)] | — | — | 700 | * |
| Internal pressure (Pa) | 40 | 80 | 80 | * |
| High-frequency power (W) | 400 | 800 | 450 | * |
| Substrate temp. (° C.) | 260 | 260 | 290 | 290 |
| Layer thickness (μm) | 3 | 25 | 0.5 | 0.5 |

In Table 21, "Charge injection preventing layer" is the lower-part charge injection preventing layer.

In Table 21, the layer thickness of each layer shows a designed value on the designing of each electrophotographic photosensitive member. The conditions of gases, internal pressure and high-frequency power for the surface layer in Table 21 are also shown in Table 22 for each electrophotographic photosensitive member.

TABLE 22

| Film forming conditions No. | 101 | 102 | 103 | 104 |
|---|---|---|---|---|
| $SiH_4$ [mL/min(normal)] | 26 | 26 | 26 | 26 |
| $CH_4$ [ml/min(normal)] | 500 | 450 | 400 | 360 |
| Internal pressure (Pa) | 80 | 80 | 80 | 80 |
| High-frequency power (W) | 600 | 700 | 750 | 850 |

The electrophotographic photosensitive members thus produced were measured by the following analytical methods on the items of Si+C atom density, H/(Si+C+H), C/(Si+C) and $I_D/I_G$.

Si+C Atom Density & H/(Si+C+H)

Under the same conditions as those for the electrophotographic photosensitive members produced in Examples and Comparative Examples, electrophotographic photosensitive members were each produced in which only the charge injection preventing layer 15 was formed on the substrate 14 and those in which only the charge injection preventing layer 15 and the photoconductive layer 13 were formed. These were each cut out in 15 mm square at a middle portion thereof in its lengthwise direction to prepare reference samples.

Next, under the same conditions as those in Examples and Comparative Examples, electrophotographic photosensitive members were each produced in which the charge injection preventing layer 15, the photoconductive layer 13 and the intermediate layer 12 were formed on the substrate 14, as those for measuring atom density of the intermediate layer 12. These were each cut out in the same way as the reference samples to prepare samples for intermediate layer measurement.

Further, the electrophotographic photosensitive members produced in Examples and Comparative Examples were cut out in the same way as the reference samples to prepare samples for surface layer measurement.

The reference samples, the samples for intermediate layer measurement and the samples for surface layer measurement were measured by spectroscopic ellipsometry (using a high-speed spectroscopic ellipsometer M-2000, manufactured by J.A. Woollam Co., Inc.) to determine the layer thickness of the intermediate layer 12 and surface layer 11 each. Specific conditions for the measurement by spectroscopic ellipsometry are the same as those described previously.

First, the reference samples were measured by spectroscopic ellipsometry to find the relationship between the wavelength and the amplitude ratio ψ and phase difference Δ at each incident angle.

Next, taking as a reference the results of measurement of the reference samples, the samples for measurement were each measured by spectroscopic ellipsometry like the reference samples to find the relationship between the wavelength and the amplitude ratio ψ and phase difference Δ at each incident angle.

Then, a layer structure in which the charge injection preventing layer and the photoconductive layer, the intermediate layer and the surface layer were formed in this order and which had a roughness layer where the surface layer and a pneumatic layer in a volume ratio of 8:2 were present at the outermost surface was used as a calculation model, and the relationship between the wavelength and the amplitude ratio ψ and phase difference Δ at each incident angle were found by calculation using an analytical software WVASE 32, available from J.A. Woollam Co., Inc. Further, the layer thickness of the surface layer was calculated at which the relationship between the wavelength and the amplitude ratio ψ and phase difference Δ at each incident angle that was found by this calculation and the relationship between the wavelength and the amplitude ratio ψ and phase difference Δ at each incident angle that was found by measuring the sample for measurement came minimal in their mean square error, and the value obtained was taken as the layer thickness of the surface layer.

The above sample for measurement was analyzed by RBS (Rutherford back scattering) (using a back scattering analyzer AN-2500, manufactured by Nisshin High Voltage Co., Ltd.) to measure the number of atoms of silicon atoms and carbon atoms in the surface layer and intermediate layer within the area of measurement by RBS.

The C/(Si+C) was calculated from the values thus obtained.

For the number of atoms of silicon atoms and carbon atoms determined from the area of measurement by RBS, the Si atom density, the C atom density and the Si+C atom density were calculated by using the layer thickness of surface layer that was determined by spectroscopic ellipsometry.

Simultaneously with the RBS, using the above samples, the number of atoms of hydrogen atoms in the intermediate layer and surface layer was measured by HFS (hydrogen forward scattering) (using a back scattering analyzer AN-2500, manufactured by Nisshin High Voltage Co., Ltd.) within the area of measurement by HFS.

For the number of atoms of hydrogen atoms within the area of measurement by HFS, the atom density of hydrogen atoms was determined by using the layer thickness that was determined by the spectroscopic ellipsometry. The H/(Si+C+H) within the area of measurement by HFS was also determined according to the number of atoms of silicon atoms and the number of atoms of carbon atoms within the area of measurement by RBS. Specific conditions for the measurement by RBS and HFS are the same as those described previously.

Incidentally, the Si+C atom density and the H/(Si+C+H) in the intermediate layer 12 may also be measured by removing only the surface layer 11 mechanically from the electrophotographic photosensitive member produced. This time, however, these are measured using the above samples for intermediate layer measurement.

$I_D/I_G$

To examine the $sp^3$ content, a sample prepared by cutting out the electrophotographic photosensitive member in a square shape of 10 mm square at a middle portion thereof in its lengthwise direction at its arbitrary position in peripheral direction was measured with a laser Raman spectrophotometer (NRS-2000, manufactured by JASCO Corporation). Specific conditions for the measurement with the laser Raman spectrophotometer and how to analyze the Raman spectra are the same as those described previously.

Each electrophotographic photosensitive member was also evaluated in the following way in respect of high-humidity image flow, wear resistance, blurred images, sensitivity and pressure scars.

High-Humidity Image Flow

A conversion machine of the digital electrophotographic apparatus "iR-5065" (trade name), manufactured by CANON INC., was used. This electrophotographic apparatus was what was so converted as to be 500 mm/sec in process speed, make use of a laser light source of 635 nm in lasing wavelength as imagewise exposure light and reproduce images at a resolution of 1,200 dpi.

The electrophotographic photosensitive members produced were each set in the above electrophotographic apparatus, and an A3-size whole-area character chart (4 pt, print percentage: 4%) placed on an original glass plate was reproduced in an environment of temperature 22° C. and relative humidity 50%. At this stage, initial-stage images were reproduced under conditions where a photosensitive member heater was kept in the on state to keep the surface of the electrophotographic photosensitive member at about 40° C.

Thereafter, a continuous paper feed test was conducted. Stated specifically, under conditions where the photosensitive member heater was kept in the off state, and using an A4-size test pattern with a print percentage of 1%, a continuous paper feed test on 25,000 sheets per day was conducted on up to 250,000 sheets in total. After the continuous paper feed test was finished, the electrophotographic apparatus was left to stand for 15 hours in an environment of temperature 25° C. and relative humidity 75%. After 15 hours, the apparatus was started to operate while the photosensitive member heater was kept in the off state, and the same A3-size character chart as that used in the initial-stage images reproduction was used to reproduce images.

The images reproduced at the initial stage and the images reproduced after leaving for 15 hours after the continuous paper feed test were each made electronic into a PDF (portable document file) under binary conditions of monochromatic 300 dpi by using a digital electrophotographic apparatus "iRC-5870" (trade name), manufactured by CANON INC. The images having been made electronic were processed by using ADOBE PHOTOSHOP (available from Adobe Systems Incorporated) to measure the proportion of pixels displayed in black (hereinafter also expressed as "black percentage") in an image area (251.3 mm×273 mm) corresponding to one round of the electrophotographic photosensitive member. The black percentage thus measured was evaluated by the ratio of black percentage of the images reproduced after leaving for 15 hours after the continuous paper feed test to black percentage of the initial-stage images.

In this evaluation method, it shows that, the larger the numerical value is, the less the high-humidity image flow is.

Wear Resistance

As a method for evaluating the wear resistance, the layer thickness of the surface layer of each electrophotographic photosensitive member standing immediately after its production was measured at 9 spots in the lengthwise direction of the electrophotographic photosensitive member (at 0 mm, ±50 mm, ±90 mm, ±130 mm and ±150 mm from the middle of the electrophotographic photosensitive member in its lengthwise direction) at its arbitrary position in peripheral direction and at 9 spots in the lengthwise direction thereof at a position where the electrophotographic photosensitive member was rotated by 180° from the above arbitrary position in peripheral direction, at 18 spots in total, and was calculated from an average value of the values at the 18 spots.

As a measuring method, the surface of the electrophotographic photosensitive member was vertically irradiated with light in a spot diameter of 2 mm, and the reflected light was measure by spectrometry using a spectrometer (MCPD-2000, manufactured by Otuska Electronics Co., Ltd.). The layer thickness of the surface layer was calculated on the basis of reflection waveforms obtained. Here, the wavelength range was from 500 nm to 750 nm, the photoconductive layer 13 had a refractive index of 3.30, and, as a refractive index of the intermediate layer and surface layer each, the value found by the measurement by spectroscopic ellipsometry was used which was described previously.

After the layer thickness was measured, the electrophotographic photosensitive member produced was set in the above electrophotographic apparatus converted for the purpose of experiment, and the continuous paper feed test was conducted under the same conditions as that for the high-humidity image flow in a high-humidity environment of temperature 25° C. and relative humidity 75%. After the 250,000-sheet continuous paper feed test was finished, the electrophotographic photosensitive member was taken out of the electrophotographic apparatus, where the layer thickness of its surface layer was measured at the same position as that immediately after production, and the layer thickness of the surface layer after the continuous paper feed test was calculated in the same way as that immediately after production. Then, a difference was found from average layer thickness of the surface layers standing immediately after production and after the continuous paper feed test, to calculate the depth of wear in 250,000-sheet testing.

In this evaluation method, it shows that, the smaller the numerical value is, the smaller the depth of wear is.

Blurred Images

First, at a resolution of 1,200 dpi and using an area coverage modulation dot screen formed at 45 degrees and a line density of 170 lpi (170 lines per 1 inch), gradation data were prepared in which the whole gradation range was equally distributed at 17 stages according to area coverage modulation. Here, a number was so allotted for each gradation as to give a number "17" to the darkest gradation and a number "0" to the lightest gradation to make gradation stages.

Next, the electrophotographic photosensitive member produced was set in the above electrophotographic apparatus converted for experiment, and images were reproduced on A3-size sheets in a text mode by using the above gradation data. Here, since the evaluation on blurred images is affected if the high-humidity image flow occurs, the images were reproduced in an environment of temperature 22° C. and relative humidity 50% and under such conditions that the photosensitive member heater was placed in the on state to keep the surface of the electrophotographic photosensitive member at about 40° C.

On the images obtained, image density was measured with a reflection densitometer (a spectro-densitometer X-rite 504, manufactured by X-rite, Incorporated) for each gradation. In the measurement of reflection density, images were reproduced on three sheets for each gradation, and an average value of their densities was taken as an evaluation value.

A correlation coefficient between the evaluation value thus found and each gradation stage was calculated to find a difference thereof from a correlation coefficient=1.00 that is the case that the representation of gradation in which the reflection density at each gradation changes perfectly linearly was obtained, which difference was evaluated as blurred images.

In this evaluation method, it shows that, the smaller the numerical value is, the less the blurred images are and the more closely linearly the gradation is represented.

Sensitivity

The electrophotographic photosensitive member produced was set in the above electrophotographic apparatus converted for experiment, and, in the state the imagewise exposure was turned off, a high-pressure power source was connected to each of a wire and a grid of its charging assembly. Also, setting the grid potential at 820 V, the electric current flowed to the wire of the charging assembly was controlled so as to set the surface potential of the electrophotographic photosensitive member at 450 V.

Next, in the state the electrophotographic photosensitive member was charged under the charging conditions set as above, its surface was irradiated with imagewise exposure light, and its irradiation energy was controlled to set the surface potential of the electrophotographic photosensitive member at 100 V at its position where it faced the developing assembly. The irradiation energy of imagewise exposure light that was required here was evaluated as the sensitivity.

In this evaluation method, it shows that, the smaller the numerical value is, the better sensitivity the electrophotographic photosensitive member has.

Pressure Scars

Using a surface property tester (manufactured by HEIDON Co.), a diamond needle having a curvature of 0.8 mm in diameter was brought into touch with the surface of the electrophotographic photosensitive member under application of a constant load thereto. In this state, the diamond needle was moved in the generatrix direction (lengthwise direction) of the electrophotographic photosensitive member at a speed of 50 mm/minute. The distance of movement may arbitrary set. Here, it was set in 10 mm.

This operation was repeated while changing positions at which the needle was brought into touch with the surface of the electrophotographic photosensitive member, and while increasing the load applied to the diamond needle, by every 5 g from 50 g.

The surface of the electrophotographic photosensitive member on which the surface property test was thus conducted was observed with a microscope to make sure whether or not any scratches were made. Thereafter, the electrophotographic photosensitive member was set in the above electrophotographic apparatus, and images giving a reflection density of 0.5 were reproduced using an original printed with halftone images.

The images reproduced by the above procedure were visually observed, and the minimum load at which the pressure scars came to be seen was compared.

In this evaluation method, it shows that, the larger the numerical value is, the less the pressure scars may come about.

Comparative Example 8

An electrophotographic photosensitive member was produced in the same manner as in Example 7 under conditions shown in Table 21. Gas conditions, internal pressure and high-frequency power used in this Comparative Example in forming the surface layer 11 are shown in Table 23.

TABLE 23

| Film forming conditions No. | 105 |
|---|---|
| $SiH_4$ [mL/min(normal)] | 26 |
| $CH_4$ [ml/min(normal)] | 700 |
| Internal pressure (Pa) | 80 |
| High-frequency power (W) | 450 |

Comparative Example 9

An electrophotographic photosensitive member was produced in the same manner as in Example 7, but under conditions shown in Table 24 below. Film forming conditions for the electrophotographic photosensitive member produced in this Comparative Example were denoted as Film forming conditions No. 106.

TABLE 24

| | Charge injecttion preventing layer | Photo-conduc-tive layer | Inter-mediate layer | Sur-face layer |
|---|---|---|---|---|
| Gases & gas flow rates: | | | | |
| $SiH_4$ [mL/min(normal)] | 350 | 450 | 26 | 26 |
| $H_2$ [mL/min(normal)] | 750 | 2,200 | — | — |
| $B_2H_6$ (ppm) (based on $SiH_4$) | 1,500 | 1 | — | — |
| NO [ml/min(normal)] | 10 | — | — | — |
| $CH_4$ [ml/min(normal)] | — | — | 700 | 1,400 |
| Internal pressure (Pa) | 40 | 80 | 80 | 55 |
| High-frequency power (W) | 400 | 800 | 450 | 400 |
| Substrate temp. (° C.) | 260 | 260 | 290 | 260 |
| Layer thickness (μm) | 3 | 25 | 0.5 | 0.5 |

In Table 24, "Charge injection preventing layer" is the lower-part charge injection preventing layer.

The electrophotographic photosensitive members thus produced were evaluated in the same way as in Example 7.

As above, about Example 7 and Comparative Examples 8 and 9, the values of analyses of the Si atom density, C atom density, Si+C atom density, C/(Si+C), H atom density, H/(Si+C+H) and $I_D/I_G$ and the results of evaluation on the high-humidity image flow, wear resistance, blurred images, sensitivity and pressure scars are shown in Table 25.

TABLE 25

| | Cp. 9 | Cp. 8 | Example 7 | | | |
|---|---|---|---|---|---|---|
| Film forming conditions No. | 106 | 105 | 101 | 102 | 103 | 104 |
| Surface layer: | | | | | | |
| Si atom density ($\times 10^{22}$ atom/cm$^3$) | 1.81 | 1.61 | 1.72 | 1.81 | 1.84 | 1.94 |
| C atom density ($\times 10^{22}$ atom/cm$^3$) | 4.44 | 4.82 | 4.88 | 4.88 | 4.97 | 5.00 |
| Si + C atom density ($\times 10^{22}$ atom/cm$^3$) | 6.25 | 6.42 | 6.60 | 6.69 | 6.81 | 6.94 |
| C/(Si + C) | 0.71 | 0.75 | 0.74 | 0.73 | 0.73 | 0.72 |

TABLE 25-continued

| | Cp. 9 | Cp. 8 | Example 7 | | | |
|---|---|---|---|---|---|---|
| Film forming conditions No. | 106 | 105 | 101 | 102 | 103 | 104 |
| H atom density ($\times 10^{22}$ atom/cm$^3$) | 4.00 | 5.25 | 4.98 | 5.26 | 4.73 | 4.82 |
| H/(Si + C + H) | 0.39 | 0.45 | 0.43 | 0.44 | 0.41 | 0.41 |
| $I_D/I_G$ | 0.7 | 0.69 | 0.69 | 0.67 | 0.62 | 0.61 |
| Layer thickness (nm) | 498 | 491 | 495 | 490 | 499 | 489 |
| | Intermediate layer: | | | | | |
| Si atom density ($\times 10^{22}$ atom/cm$^3$) | | | 1.61 | | | |
| C atom density ($\times 10^{22}$ atom/cm$^3$) | | | 4.82 | | | |
| Si + C atom density ($\times 10^{22}$ atom/cm$^3$) | | | 6.43 | | | |
| C/(Si + C) | | | 0.75 | | | |
| H atom density ($\times 10^{22}$ atom/cm$^3$) | | | 5.05 | | | |
| H/(Si + C + H) | | | 0.44 | | | |
| Layer thickness (nm) | 489 | 498 | 494 | 487 | 496 | 493 |
| High-humidity image flow | 0.64 | 0.86 | 0.97 | 1.00 | 1.04 | 1.07 |
| Wear resistance | 1.75 | 1.40 | 1.03 | 1.00 | 0.89 | 0.84 |
| Blurred images | 1.20 | 1.39 | 0.87 | 1.00 | 1.33 | 1.00 |
| Sensitivity | 0.90 | 0.94 | 0.99 | 1.00 | 1.01 | 1.01 |
| Pressure scars | 0.63 | 0.80 | 0.97 | 1.00 | 1.03 | 1.03 |

Cp.: Comparative Example

As shown in Table 25, the intermediate layers 12 of the electrophotographic photosensitive members under the respective "Film forming conditions" are all those formed under the like conditions. Hence, as to the Si atom density, C atom density, Si+C atom density, C/(Si+C), H atom density and H/(Si+C+H) in the intermediate layer 12, the values found from one sample for measuring intermediate layer atom density represent the values of all the electrophotographic photosensitive members.

As the layer thickness of each intermediate layer 12, the value is used which was found by measuring each sample by ellipsometry.

As to the items of the high-humidity image flow, wear resistance, blurred images, sensitivity and pressure scars, the results are shown as those of relative evaluation made on the basis of the value under Film forming conditions No. 102 in Example 7.

In the above relative evaluation, the electrophotographic photosensitive member can be said to have no problem in practical use as long as the value on high-humidity image flow is 0.60 or more and have superior high-humidity image flow resistance when the value is 0.95 or more. It can also be said to have especially superior high-humidity image flow resistance when the value is 1.02 or more.

About the wear resistance, the electrophotographic photosensitive member can be said to have no problem in practical use as long as the value is 1.90 or less and have especially superior wear resistance when the value is 0.90 or less.

About the blurred images, when the value is 2.30 or less the electrophotographic photosensitive member can be said to give gradation having no problem in practical use on almost all the images reproduced, and, as long as the value is 1.8 or less, give good gradation not perceivable of any tone jump on images. Also, it can be said to give especially superior gradation representation when the value is 1.50 or less, but those showing the value of less than 1.50 can be said to give gradation substantially not perceivable of any difference on images and to be within the range of dispersion on measurement.

About the sensitivity, the electrophotographic photosensitive member can be said to have no problem in practical use as long as the value is 1.50 or less and have good characteristics as long as the value is 1.10 or less. When the value is 1.05 or less, it can also be said to have good characteristics applicable to electrophotographic processes in a wide range.

About the pressure scars, the electrophotographic photosensitive member can be said to have no problem in practical use as long as the value is 0.50 or more and, when the value is 0.95 or more, have good characteristics giving a very low probability of causing the pressure scars.

From the results shown in Table 25, it is seen that setting the Si+C atom density in the surface layer at $6.60\times10^{22}$atom/cm$^3$ or more brings improvements in high-humidity image flow resistance and wear resistance. It is also seen that setting the Si+C atom density in the surface layer 11 at $6.81\times10^{22}$atom/cm$^3$ or more brings a more remarkable improvement in wear resistance.

It is still also seen that, in the electrophotographic photosensitive members of Comparative Examples 8 and 9, the evaluation on pressure scars is low because of a low Si+C atom density in the surface layer 11.

Example 8

Electrophotographic photosensitive members were produced in the same manner as in Example 7 under conditions shown in Table 21. Conditions for gases, internal pressure and high-frequency power used in this Example in forming the surface layer 11 are shown in Table 26.

TABLE 26

| Film forming conditions No. | 107 | 108 | 109 | 110 | 111 |
|---|---|---|---|---|---|
| $SiH_4$ [mL/min(normal)] | 35 | 26 | 26 | 20 | 15 |
| $CH_4$ [ml/min(normal)] | 190 | 150 | 190 | 360 | 400 |
| Internal pressure (Pa) | 70 | 70 | 70 | 70 | 70 |
| High-frequency power (W) | 750 | 800 | 700 | 900 | 900 |

Comparative Example 10

Electrophotographic photosensitive members were produced in the same manner as in Example 7 under conditions shown in Table 21. Gas conditions, internal pressure and high-frequency power used in this Comparative Example in forming the surface layer 11 are shown in Table 27.

TABLE 27

| Film forming conditions No. | 112 | 113 |
|---|---|---|
| $SiH_4$ [mL/min(normal)] | 35 | 12 |
| $CH_4$ [ml/min(normal)] | 190 | 500 |
| Internal pressure (Pa) | 70 | 70 |
| High-frequency power (W) | 700 | 900 |

The electrophotographic photosensitive members thus produced in Example 8 and Comparative Example 10 were evaluated in the same way as in Example 7.

About Example 8 and Comparative Example 10, the values of analyses of the Si atom density, C atom density, Si+C atom density, C/(Si+C), H atom density, H/(Si+C+H) and $I_D/I_G$ and the results of evaluation on the high-humidity image flow, wear resistance, blurred images, sensitivity and pressure scars are shown in Table 28.

As shown in Table 28, the intermediate layers 12 of the electrophotographic photosensitive members under the respective "Film forming conditions" are all those formed under the like conditions. Hence, as to the Si atom density, C atom density, Si+C atom density, C/(Si+C), H atom density and H/(Si+C+H) in the intermediate layer 12, the values found from one sample for measuring intermediate layer atom density represent the values of all the electrophotographic photosensitive members.

As the layer thickness of each intermediate layer 12, the value is used which was found by measuring each sample by ellipsometry.

As to the items of the high-humidity image flow, wear resistance, blurred images, sensitivity and pressure scars, the results are shown as those of relative evaluation made on the basis of the value under Film forming conditions No. 102 in Example 7.

From the results shown in Table 28, it is seen that setting the C/(Si+C) in the surface layer 11 at from 0.61 or more to 0.75 or less achieves good characteristics for both the blurred images and the sensitivity.

Example 9

Electrophotographic photosensitive members were produced in the same manner as in Example 7 under conditions shown in Table 29.

TABLE 28

| | Cp. 10 | Example 8 | | | | | Cp. 10 |
|---|---|---|---|---|---|---|---|
| Film forming conditions No. | 112 | 107 | 108 | 109 | 110 | 111 | 113 |
| Surface layer: | | | | | | | |
| Si at. density ($\times 10^{22}$ atom/cm$^3$) | 3.01 | 2.89 | 2.89 | 2.58 | 1.84 | 1.76 | 1.52 |
| C atom density ($\times 10^{22}$ atom/cm$^3$) | 4.34 | 4.51 | 4.92 | 4.80 | 5.25 | 5.27 | 5.40 |
| Si + C at. dens. ($\times 10^{22}$ atom/cm$^3$) | 7.35 | 7.4 | 7.81 | 7.38 | 7.09 | 7.02 | 6.92 |
| C/(Si + C) | 0.59 | 0.61 | 0.63 | 0.65 | 0.74 | 0.75 | 0.78 |
| H atom density ($\times 10^{22}$ atom/cm$^3$) | 3.46 | 3.32 | 3.35 | 3.32 | 4.16 | 3.95 | 4.42 |
| H/(Si + C + H) | 0.32 | 0.31 | 0.30 | 0.31 | 0.37 | 0.36 | 0.39 |
| $I_D/I_G$ | 0.54 | 0.52 | 0.50 | 0.58 | 0.60 | 0.63 | 0.69 |
| Layer thickness (nm) | 485 | 491 | 499 | 493 | 497 | 493 | 498 |
| Intermediate layer: | | | | | | | |
| Si at. density ($\times 10^{22}$ atom/cm$^3$) | | | | 1.61 | | | |
| C atom density ($\times 10^{22}$ atom/cm$^3$) | | | | 4.82 | | | |
| Si + C at. dens. ($\times 10^{22}$ atom/cm$^3$) | | | | 6.42 | | | |
| C/(Si + C) | | | | 0.75 | | | |
| H atom density ($\times 10^{22}$ atom/cm$^3$) | | | | 5.04 | | | |
| H/(Si + C + H) | | | | 0.44 | | | |
| Layer thickness (nm) | 492 | 492 | 482 | 495 | 479 | 486 | 490 |
| High-humidity image flow | 1.10 | 1.11 | 1.10 | 1.11 | 1.10 | 1.09 | 1.06 |
| Wear resistance | 0.81 | 0.79 | 0.76 | 0.81 | 0.83 | 0.83 | 0.84 |
| Blurred images | 2.13 | 1.67 | 1.53 | 1.40 | 1.00 | 1.33 | 1.07 |
| Sensitivity | 1.02 | 1.02 | 1.03 | 1.01 | 1.03 | 1.03 | 1.11 |
| Pressure scars | 1.03 | 1.03 | 1.03 | 1.00 | 1.03 | 1.07 | 1.03 |

Cp.: Comparative Example

TABLE 29

| | Charge injecttion preventing layer | Photo-conduc-tive layer | Inter-mediate layer | Sur-face layer |
|---|---|---|---|---|
| Gases & gas flow rates: | | | | |
| $SiH_4$ [mL/min(normal)] | 350 | 450 | * | 26 |
| $H_2$ [mL/min(normal)] | 750 | 2,200 | — | — |
| $B_2H_6$ (ppm) (based on $SiH_4$) | 1,500 | 1 | — | — |
| NO [ml/min(normal)] | 10 | — | — | — |
| $CH_4$ [ml/min(normal)] | — | — | * | 500 |
| Internal pressure (Pa) | 40 | 80 | 95 | 80 |
| High-frequency power (W) | 400 | 800 | * | 600 |
| Substrate temp. (° C.) | 260 | 260 | 290 | 290 |
| Layer thickness (μm) | 3 | 25 | 0.5 | 0.5 |

In Table 29, "Charge injection preventing layer" is the lower-part charge injection preventing layer.

In Table 29, the layer thickness of each layer shows a designed value on the designing of each electrophotographic photosensitive member. The conditions of gases and high-frequency power in Table 21 in forming the intermediate layer 12 are also shown in Table 30 for each electrophotographic photosensitive member.

TABLE 30

| Film forming conditions No. | 114 | 115 | 116 | 117 |
|---|---|---|---|---|
| $SiH_4$ [mL/min(normal)] | 65 | 50 | 50 | 26 |
| $CH_4$ [ml/min(normal)] | 1,050 | 750 | 750 | 550 |
| High-frequency power (W) | 400 | 350 | 450 | 450 |

Example 21

Electrophotographic photosensitive members were produced in the same manner as in Example 7 under conditions shown in Table 29. Gas conditions and high-frequency power used in this Example in forming the intermediate layer 12 are shown in Table 31.

TABLE 31

| Film forming conditions No. | 118 | 119 |
|---|---|---|
| $SiH_4$ [mL/min(normal)] | 65 | 35 |
| $CH_4$ [ml/min(normal)] | 1,050 | 450 |
| High-frequency power (W) | 300 | 800 |

Example 22

An electrophotographic photosensitive member was produced in the same manner as in Example 7 under conditions shown in Table 32. In this Example, the intermediate layer was not provided to produce an electrophotographic photosensitive member having layer configuration of the lower-part charge injection preventing layer 13, the photoconductive layer 15 and the surface layer 11 on the substrate 14. Film forming conditions for the electrophotographic photosensitive member produced in this Example were denoted as Film forming conditions No. 120.

TABLE 32

| | Charge injection preventing layer | Photo-conductive layer | Surface layer |
|---|---|---|---|
| Gases & gas flow rates: | | | |
| $SiH_4$ [mL/min(normal)] | 350 | 450 | 26 |
| $H_2$ [mL/min(normal)] | 750 | 2,200 | — |
| $B_2H_6$ (ppm)(based on $SiH_4$) | 1,500 | 1 | — |
| NO [ml/min(normal)] | 10 | — | — |
| $CH_4$ [ml/min(normal)] | — | — | 500 |
| Internal pressure (Pa) | 40 | 80 | 80 |
| High-frequency power (W) | 400 | 800 | 600 |
| Substrate temperature (° C.) | 260 | 260 | 290 |
| Layer thickness (μm) | 3 | 25 | 1 |

In Table 32, "Charge injection preventing layer" is the lower-part charge injection preventing layer.

The electrophotographic photosensitive members thus produced in Example 9 and Examples 21 and 22 were evaluated in the same way as in Example 7. About Example 9 and Examples 21 and 22, the values of analyses of the Si atom density, C atom density, Si+C atom density, C/(Si+C), H atom density, H/(Si+C+H) and $I_D/I_G$ and the results of evaluation on the high-humidity image flow, wear resistance, blurred images, sensitivity and pressure scars are shown in Table 33.

TABLE 33

| | Ex. 21 | Example 9 | | | | Ex. 21 | Ex. 22 |
|---|---|---|---|---|---|---|---|
| Film forming conditions No. | 118 | 114 | 115 | 116 | 117 | 119 | 120 |
| Surface layer: | | | | | | | |
| Si at. density ($\times 10^{22}$ atom/cm$^3$) | 2.57 | 2.58 | 2.51 | 2.57 | 2.51 | 2.58 | 2.57 |
| C atom density ($\times 10^{22}$ atom/cm$^3$) | 4.03 | 4.03 | 4.10 | 4.03 | 4.09 | 4.03 | 4.03 |
| Si + C at. dens. ($\times 10^{22}$ atom/cm$^3$) | 6.60 | 6.61 | 6.61 | 6.60 | 6.60 | 6.61 | 6.60 |
| C/(Si + C) | 0.61 | 0.61 | 0.62 | 0.61 | 0.62 | 0.61 | 0.61 |
| H atom density ($\times 10^{22}$ atom/cm$^3$) | 4.98 | 5.19 | 4.99 | 5.19 | 4.98 | 4.99 | 4.98 |
| H/(Si + C + H) | 0.43 | 0.44 | 0.43 | 0.44 | 0.43 | 0.43 | 0.43 |
| $I_D/I_G$ | 0.69 | 0.70 | 0.69 | 0.68 | 0.70 | 0.69 | 0.69 |
| Layer thickness (nm) | 485 | 491 | 499 | 497 | 493 | 495 | 996 |

TABLE 33-continued

| | Ex. 21 | Example 9 | | | | Ex. 21 | Ex. 22 |
|---|---|---|---|---|---|---|---|
| Film forming conditions No. | 118 | 114 | 115 | 116 | 117 | 119 | 120 |
| Intermediate layer: | | | | | | | |
| Si at. density ($\times 10^{22}$ atom/cm$^3$) | 1.51 | 1.54 | 1.76 | 1.78 | 1.67 | 2.09 | — |
| C atom density ($\times 10^{22}$ atom/cm$^3$) | 3.69 | 3.97 | 4.10 | 4.37 | 4.77 | 4.65 | — |
| Si + C at. dens. ($\times 10^{22}$ atom/cm$^3$) | 5.20 | 5.51 | 5.85 | 6.15 | 6.44 | 6.74 | — |
| C/(Si + C) | 0.71 | 0.72 | 0.70 | 0.71 | 0.74 | 0.69 | — |
| H atom density ($\times 10^{22}$ atom/cm$^3$) | 3.61 | 3.67 | 3.74 | 4.10 | 4.12 | 4.13 | — |
| H/(Si + C + H) | 0.41 | 0.40 | 0.39 | 0.40 | 0.39 | 0.38 | — |
| Layer thickness (nm) | 492 | 492 | 492 | 495 | 496 | 490 | — |
| High-humidity image flow | 0.97 | 0.99 | 0.98 | 1.00 | 0.99 | 0.97 | 0.97 |
| Wear resistance | 1.05 | 1.03 | 1.03 | 1.00 | 1.08 | 1.08 | 1.05 |
| Blurred images | 1.00 | 0.73 | 0.87 | 0.87 | 1.13 | 0.87 | 1.07 |
| Sensitivity | 0.87 | 0.87 | 0.87 | 0.88 | 0.96 | 1.15 | 1.11 |
| Pressure scars | 0.77 | 1.03 | 1.13 | 1.03 | 0.97 | 0.80 | 0.80 |

Ex.: Example

In Table 33, as to the items of the high-humidity image flow, wear resistance, blurred images, sensitivity and pressure scars, the results are shown as those of relative evaluation made on the basis of the value under Film forming conditions No. 102 in Example 7.

From the results shown in Table 33, it is seen that setting the Si+C atom density in the intermediate layer 12 at from $5.50\times 10^{22}$atom/cm$^3$ or more to $6.45\times 10^{22}$atom/cm$^3$ or less proves the range in which the pressure scars can well be kept from coming about. It is also seen that setting the Si+C atom density therein at $6.45\times 10^{22}$atom/cm$^3$ or less brings an improvement in sensitivity as well.

In particular, in comparison with the results of Example 22, it is seen that combining the intermediate layer 12 with the surface layer 11 as in the present invention brings improvements in all the pressure mar resistance and sensitivity even under substantially equal layer thickness.

Example 10

Electrophotographic photosensitive members were produced in the same manner as in Example 7 under conditions shown in Table 34.

TABLE 34

| | Charge injecttion preventing layer | Photo-conduc-tive layer | Inter-mediate layer | Sur-face layer |
|---|---|---|---|---|
| Gases & gas flow rates: | | | | |
| $SiH_4$ [mL/min(normal)] | 350 | 450 | * | 26 |
| $H_2$ [mL/min(normal)] | 750 | 2,200 | — | — |
| $B_2H_6$ (ppm) (based on $SiH_4$) | 1,500 | 1 | — | — |
| NO [ml/min(normal)] | 10 | — | — | — |
| $CH_4$ [ml/min(normal)] | — | — | * | 500 |
| Internal pressure (Pa) | 40 | 80 | 95 | 80 |
| High-frequency power (W) | 400 | 800 | * | 600 |
| Substrate temp. (° C.) | 260 | 260 | 290 | 290 |
| Layer thickness (μm) | 3 | 25 | 0.5 | 0.5 |

In Table 34, "Charge injection preventing layer" is the lower-part charge injection preventing layer.

In Table 34, the layer thickness of each layer shows a designed value on the designing of each electrophotographic photosensitive member. The conditions of gases and high-frequency power in Table 34 in forming the intermediate layer 12 are also shown in Table 35 for each electrophotographic photosensitive member.

TABLE 35

| Film forming conditions No. | 121 | 122 | 123 |
|---|---|---|---|
| $SiH_4$ [mL/min(normal)] | 50 | 50 | 50 |
| $CH_4$ [ml/min(normal)] | 455 | 750 | 1,035 |
| High-frequency power (W) | 300 | 480 | 600 |

Example 23

Electrophotographic photosensitive members were produced in the same manner as in Example 7 under conditions shown in Table 34. Gas conditions and high-frequency power used in this Example in forming the intermediate layer 12 are shown in Table 36.

TABLE 36

| Film forming conditions No. | 124 | 125 |
|---|---|---|
| $SiH_4$ [mL/min(normal)] | 50 | 50 |
| $CH_4$ [ml/min(normal)] | 300 | 1,500 |
| High-frequency power (W) | 200 | 900 |

The electrophotographic photosensitive members thus produced in Examples 10 and 23 were evaluated in the same way as in Example 7. About Examples 10 and 23, the values of analyses of the Si atom density, C atom density, Si+C atom density, C/(Si+C), H atom density, H/(Si+C+H) and $I_D/I_G$ and the results of evaluation on the high-humidity image flow, wear resistance, blurred images, sensitivity and pressure scars are shown in Table 37.

TABLE 37

| | Ex. 23 | Example 10 | | | Ex. 23 |
|---|---|---|---|---|---|
| | Film forming conditions No. | | | | |
| | 124 | 121 | 122 | 123 | 125 |
| Surface layer: | | | | | |
| Si atom density ($\times 10^{22}$ atom/cm$^3$) | 2.51 | 2.57 | 2.57 | 2.51 | 2.57 |
| C atom density ($\times 10^{22}$ atom/cm$^3$) | 4.10 | 4.03 | 4.03 | 4.10 | 4.03 |
| Si + C atom density ($\times 10^{22}$ atom/cm$^3$) | 6.61 | 6.60 | 6.60 | 6.61 | 6.60 |
| C/(Si + C) | 0.62 | 0.61 | 0.61 | 0.62 | 0.61 |
| H atom density ($\times 10^{22}$ atom/cm$^3$) | 4.99 | 4.98 | 5.19 | 4.99 | 4.59 |
| H/(Si + C + H) | 0.43 | 0.43 | 0.44 | 0.43 | 0.41 |
| $I_D/I_G$ | 0.69 | 0.70 | 0.69 | 0.68 | 0.69 |
| Layer thickness (nm) | 485 | 491 | 497 | 493 | 498 |
| Intermediate layer: | | | | | |
| Si atom density ($\times 10^{22}$ atom/cm$^3$) | 2.73 | 2.41 | 1.87 | 1.54 | 1.30 |
| C atom density ($\times 10^{22}$ atom/cm$^3$) | 3.47 | 3.77 | 4.36 | 4.61 | 4.90 |
| Si + C atom density ($\times 10^{22}$ atom/cm$^3$) | 6.20 | 6.18 | 6.23 | 6.15 | 6.20 |
| C/(Si + C) | 0.56 | 0.61 | 0.70 | 0.75 | 0.79 |
| H atom density ($\times 10^{22}$ atom/cm$^3$) | 4.13 | 4.29 | 4.15 | 4.45 | 4.68 |
| H/(Si + C + H) | 0.40 | 0.41 | 0.40 | 0.42 | 0.43 |
| Layer thickness (nm) | 492 | 492 | 479 | 486 | 491 |
| High-humidity image flow | 0.97 | 0.98 | 0.99 | 0.98 | 0.98 |
| Wear resistance | 1.08 | 1.06 | 1.08 | 1.05 | 1.06 |
| Blurred images | 1.89 | 1.67 | 1.00 | 1.33 | 1.07 |
| Sensitivity | 0.87 | 0.88 | 0.89 | 0.92 | 1.11 |
| Pressure scars | 1.00 | 1.03 | 1.03 | 1.07 | 1.03 |

Ex.: Example

In Table 37, as to the items of the high-humidity image flow, wear resistance, blurred images, sensitivity and pressure scars, the results are shown as those of relative evaluation made on the basis of the value under Film forming conditions No. 102 in Example 7.

From the results shown in Table 37, it is seen that setting the C/(Si+C) in the intermediate layer 12 at from 0.61 or more to 0.75 or less achieves good characteristics for both the blurred images and the sensitivity.

Here, the influence of the C/(Si+C) on the sensitivity in the intermediate layer differs from the results shown in Table 28. This is presumed to be probably due to an influence of the reflection of imagewise exposure light that occurs at the interface between the photoconductive layer 13 and the intermediate layer 12.

Example 11

Electrophotographic photosensitive members were produced in the same manner as in Example 7 under conditions shown in Table 38.

TABLE 38

| | Charge injecttion preventing layer | Photo-conduc-tive layer | Inter-mediate layer | Sur-face layer |
|---|---|---|---|---|
| Gases & gas flow rates: | | | | |
| $SiH_4$ [mL/min(normal)] | 350 | 450 | 26 | 26 |
| $H_2$ [mL/min(normal)] | 750 | 2,200 | — | — |
| $B_2H_6$ (ppm) (based on $SiH_4$) | 1,500 | 1 | — | — |
| NO [ml/min(normal)] | 10 | — | — | — |
| $CH_4$ [ml/min(normal)] | — | — | 700 | 190 |
| Internal pressure (Pa) | 40 | 80 | 65 | 65 |
| High-frequency power (W) | 400 | 800 | 450 | 700 |
| Substrate temp. (° C.) | 260 | 260 | 290 | 290 |
| Layer thickness (μm) | 3 | 25 | * | 0.1 |

In Table 38, "Charge injection preventing layer" is the lower-part charge injection preventing layer.

In Table 38, the layer thickness of each layer shows a designed value on the designing of each electrophotographic photosensitive member. In this Example, the layer thickness of the intermediate layer 12 was changed in the range of from 153 nm to 696 nm.

Example 24

Electrophotographic photosensitive members were produced in the same manner as in Example 11 under conditions shown in Table 38. In this Example, the layer thickness of the intermediate layer 12 was set to be 98 nm and 135 nm to produce them.

The electrophotographic photosensitive members thus produced in Examples 11 and 24 were evaluated in the same way as in Example 7. About Examples 11 and 24, the values of analyses of the Si atom density, C atom density, Si+C atom density, C/(Si+C), H atom density, H/(Si+C+H) and $I_D/I_G$ and the results of evaluation on the high-humidity image flow, wear resistance, blurred images, sensitivity and pressure scars are shown in Table 39.

TABLE 39

| | Example 24 | | Example 11 | | |
|---|---|---|---|---|---|
| | Film forming conditions No. | | | | |
| | 130 | 131 | 126 | 127 | 129 |
| Surface layer: | | | | | |
| Si atom density ($\times 10^{22}$ atom/cm$^3$) | 2.58 | 2.66 | 2.58 | 2.73 | 2.58 |
| C atom density ($\times 10^{22}$ atom/cm$^3$) | 4.80 | 4.73 | 4.79 | 4.65 | 4.80 |
| Si + C atom density ($\times 10^{22}$ atom/cm$^3$) | 7.38 | 7.39 | 7.37 | 7.38 | 7.38 |
| C/(Si + C) | 0.65 | 0.64 | 0.65 | 0.63 | 0.65 |
| H atom density ($\times 10^{22}$ atom/cm$^3$) | 3.97 | 4.16 | 3.97 | 4.15 | 3.80 |
| H/(Si + C + H) | 0.35 | 0.36 | 0.35 | 0.36 | 0.34 |
| $I_D/I_G$ | 0.58 | 0.56 | 0.58 | 0.59 | 0.56 |
| Layer thickness (nm) | 93 | 96 | 99 | 101 | 98 |
| Intermediate layer: | | | | | |
| Si atom density ($\times 10^{22}$ atom/cm$^3$) | | | 1.61 | | |
| C atom density ($\times 10^{22}$ atom/cm$^3$) | | | 4.82 | | |
| Si + C atom density ($\times 10^{22}$ atom/cm$^3$) | | | 6.42 | | |
| C/(Si + C) | | | 0.75 | | |

TABLE 39-continued

| | Example 24 | | Example 11 | | |
|---|---|---|---|---|---|
| | Film forming conditions No. | | | | |
| | 130 | 131 | 126 | 127 | 129 |
| H atom density ($\times 10^{22}$ atom/cm$^3$) | | | 5.04 | | |
| H/(Si + C + H) | | | 0.44 | | |
| Layer thickness (nm) | 98 | 135 | 153 | 269 | 696 |
| High-humidity image flow | 1.09 | 1.11 | 1.09 | 1.10 | 1.10 |
| Wear resistance | 0.81 | 0.81 | 0.83 | 0.81 | 0.81 |
| Blurred images | 1.33 | 1.07 | 1.00 | 1.33 | 1.07 |
| Sensitivity | 0.90 | 0.90 | 0.90 | 0.91 | 0.94 |
| Pressure scars | 0.77 | 0.87 | 1.00 | 1.00 | 0.97 |

As shown in Table 39, the intermediate layers 12 of the electrophotographic photosensitive members under the respective "Film forming conditions" are all those formed under the like conditions. Hence, as to the Si atom density, C atom density, Si+C atom density, C/(Si+C), H atom density and H/(Si+C+H) in the intermediate layer 12, the values found from one sample for measuring intermediate layer atom density represent the values of all the electrophotographic photosensitive members.

As the layer thickness of each intermediate layer 12, the value is used which was found by measuring each sample by ellipsometry.

As to the items of the high-humidity image flow, wear resistance, blurred images, sensitivity and pressure scars, the results are shown as those of relative evaluation made on the basis of the value under Film forming conditions No. 102 in Example 7.

As above, from the results shown in Table 39, it is seen that setting the layer thickness of the intermediate layer 12 to be 150 nm or more is effective in keeping the pressure scars from coming about.

In addition, in Example 11, the sensitivity does not vary so much depending on the layer thickness of the intermediate layer 12. Accordingly, it is presumed to be more effective in improving the sensitivity that the intermediate layer 12 is combined with the surface layer 11 to protect the surface than that all the layer thickness necessary therefor is covered by the surface layer 11 alone.

Example 12

Electrophotographic photosensitive members were produced in the same manner as in Example 7 under conditions shown in Table 40.

TABLE 40

| | Charge injecttion preventing layer | Photo-conduc-tive layer | Inter-mediate layer | Sur-face layer |
|---|---|---|---|---|
| Gases & gas flow rates: | | | | |
| $SiH_4$ [mL/min(normal)] | 350 | 450 | 50 | * |
| $H_2$ [mL/min(normal)] | 750 | 2,200 | — | * |
| $B_2H_6$ (ppm) (based on $SiH_4$) | 1,500 | 1 | — | — |
| NO [ml/min(normal)] | 10 | — | — | — |
| $CH_4$ [ml/min(normal)] | — | — | 750 | * |
| Internal pressure (Pa) | 40 | 80 | 95 | 80 |
| High-frequency power (W) | 400 | 800 | 350 | * |

TABLE 40-continued

| | Charge injecttion preventing layer | Photo-conduc-tive layer | Inter-mediate layer | Sur-face layer |
|---|---|---|---|---|
| Substrate temp. (° C.) | 260 | 260 | 290 | 290 |
| Layer thickness (μm) | 3 | 25 | 0.5 | 0.5 |

In Table 40, "Charge injection preventing layer" is the lower-part charge injection preventing layer.

In Table 40, the layer thickness of each layer shows a designed value on the designing of each electrophotographic photosensitive member. The conditions of gases and high-frequency power in Table 40 in forming the surface layer 11 are also shown in Table 41 for each electrophotographic photosensitive member.

TABLE 41

| Film forming conditions No. | 132 | 133 | 134 | 135 | 136 |
|---|---|---|---|---|---|
| $SiH_4$ [mL/min(normal)] | 26 | 26 | 26 | 26 | 26 |
| $CH_4$ [ml/min(normal)] | 200 | 350 | 400 | 450 | 600 |
| $H_2$ [ml/min(normal)] | 350 | 250 | 250 | 250 | 100 |
| High-frequency power (W) | 1,500 | 1,500 | 1,200 | 1,200 | 1,200 |

The electrophotographic photosensitive members thus produced were evaluated in the same way as in Example 7. About Example 12, the values of analyses of the Si atom density, C atom density, Si+C atom density, C/(Si+C), H atom density, H/(Si+C+H) and $I_D/I_G$ and the results of evaluation on the high-humidity image flow, wear resistance, blurred images, sensitivity and pressure scars are shown in Table 42.

TABLE 42

| Film | Example 12 | | | | |
|---|---|---|---|---|---|
| forming conditions No. | 132 | 133 | 134 | 135 | 136 |
| Surface layer: | | | | | |
| Si atom density ($\times 10^{22}$ atom/cm$^3$) | 2.60 | 2.40 | 2.29 | 2.21 | 2.12 |
| C atom density ($\times 10^{22}$ atom/cm$^3$) | 4.61 | 4.67 | 4.66 | 4.69 | 4.73 |
| Si + C atom density ($\times 10^{22}$ atom/cm$^3$) | 7.21 | 7.07 | 6.95 | 6.90 | 6.85 |
| C/(Si + C) | 0.64 | 0.66 | 0.67 | 0.68 | 0.69 |
| H atom density ($\times 10^{22}$ atom/cm$^3$) | 2.53 | 3.18 | 4.26 | 5.65 | 6.32 |
| H/(Si + C + H) | 0.26 | 0.31 | 0.38 | 0.45 | 0.48 |
| $I_D/I_G$ | 0.70 | 0.58 | 0.58 | 0.54 | 0.70 |
| Layer thickness (nm) | 498 | 499 | 489 | 493 | 495 |
| Intermediate layer: | | | | | |
| Si atom density ($\times 10^{22}$ atom/cm$^3$) | | | 1.76 | | |
| C atom density ($\times 10^{22}$ atom/cm$^3$) | | | 4.10 | | |
| Si + C atom density ($\times 10^{22}$ atom/cm$^3$) | | | 5.85 | | |
| C/(Si + C) | | | 0.70 | | |
| H atom density ($\times 10^{22}$ atom/cm$^3$) | | | 3.74 | | |
| H/(Si + C + H) | | | 0.39 | | |
| Layer thickness (nm) | 489 | 489 | 499 | 498 | 496 |
| High-humidity | 1.11 | 1.09 | 1.07 | 1.07 | 1.05 |

TABLE 42-continued

| Film forming conditions No. | Example 12 132 | 133 | 134 | 135 | 136 |
|---|---|---|---|---|---|
| image flow | | | | | |
| Wear resistance | 0.86 | 0.86 | 0.89 | 0.89 | 1.05 |
| Blurred images | 1.20 | 1.39 | 1.00 | 1.33 | 1.00 |
| Sensitivity | 1.07 | 0.97 | 0.96 | 0.96 | 0.96 |
| Pressure scars | 1.03 | 1.10 | 1.07 | 1.10 | 1.07 |

As shown in Table 42, the intermediate layers 12 of the electrophotographic photosensitive members under the respective "Film forming conditions" are all those formed under the like conditions. Hence, as to the Si atom density, C atom density, Si+C atom density, C/(Si+C), H atom density and H/(Si+C+H) in the intermediate layer 12, the values found from one sample for measuring intermediate layer atom density represent the values of all the electrophotographic photosensitive members.

As the layer thickness of each intermediate layer 12, the value is used which was found by measuring each sample by ellipsometry.

As to the items of the high-humidity image flow, wear resistance, blurred images, sensitivity and pressure scars, the results are shown as those of relative evaluation made on the basis of the value under Film forming conditions No. 102 in Example 7.

As also shown in Tables 41 and 42, the H/(Si+C+H) in the surface layer is lower than that under the film forming conditions where the hydrogen gas ($H_2$) is higher in flow rate. This is presumed to be the effect of elimination of carbon atoms in virtue of hydrogen radicals.

As is evident from Table 42, it is seen that setting the H/(Si+C+H) in the surface layer 11 at from 0.30 or more to 0.45 or less enables achievement of both the wear resistance and the sensitivity in especially favorable ranges.

Example 13

Electrophotographic photosensitive members were produced in the same manner as in Example 7 under conditions shown in Table 43.

TABLE 43

| | Charge injection preventing layer | Photo-conductive layer | Inter-mediate layer | Sur-face layer |
|---|---|---|---|---|
| Gases & gas flow rates: | | | | |
| $SiH_4$ [mL/min(normal)] | 350 | 450 | 50 | * |
| $H_2$ [mL/min(normal)] | 750 | 2,200 | — | — |
| $B_2H_6$ (ppm) (based on $SiH_4$) | 1,500 | 1 | — | — |
| NO [ml/min(normal)] | 10 | — | — | — |
| $CH_4$ [ml/min(normal)] | — | — | 750 | * |
| $C_2H_2$ [ml/min(normal)] | — | — | — | * |
| Internal pressure (Pa) | 40 | 80 | 95 | * |
| High-frequency power (W) | 400 | 800 | 350 | * |
| Substrate temp. (° C.) | 260 | 260 | 290 | 290 |
| Layer thickness (μm) | 3 | 25 | 0.5 | 0.5 |

In Table 43, "Charge injection preventing layer" is the lower-part charge injection preventing layer.

In Table 43, the layer thickness of each layer shows a designed value on the designing of each electrophotographic photosensitive member. The conditions of gases, inner pressure and high-frequency power in Table 43 in forming the surface layer 11 are also shown in Table 44 for each electrophotographic photosensitive member.

TABLE 44

| Film forming conditions No. | 137 | 138 | 139 | 140 |
|---|---|---|---|---|
| $SiH_4$ [mL/min(normal)] | 26 | 26 | 26 | 26 |
| $CH_4$ [ml/min(normal)] | 350 | 150 | 150 | 150 |
| $C_2H_2$ [ml/min(normal)] | 0 | 0 | 50 | 80 |
| Internal pressure (Pa) | 80 | 70 | 70 | 70 |
| High-frequency power (W) | 1,500 | 800 | 800 | 800 |
| High-frequency oscillation System | Pulse of 20 KHz | Contin-uous | Contin-uous | Contin-uous |

Here, as shown in Table 44, in only the electrophotographic photosensitive member of Film forming conditions No. 137, electric power with oscillation pulses of 20 kHz in frequency and 50% in duty ratio is used as the high-frequency power.

The electrophotographic photosensitive members thus produced were evaluated in the same way as in Example 7. About Example 13, the values of analyses of the Si atom density, C atom density, Si+C atom density, C/(Si+C), H atom density, H/(Si+C+H) and $I_D/I_G$ and the results of evaluation on the high-humidity image flow, wear resistance, blurred images, sensitivity and pressure scars are shown in Table 45.

TABLE 45

| Film forming conditions No. | Example 13 137 | 138 | 139 | 140 |
|---|---|---|---|---|
| Surface layer: | | | | |
| Si atom density ($\times 10^{22}$ atom/cm$^3$) | 2.23 | 2.89 | 2.41 | 2.31 |
| C atom density ($\times 10^{22}$ atom/cm$^3$) | 5.19 | 4.93 | 5.12 | 5.14 |
| Si + C atom density ($\times 10^{22}$ atom/cm$^3$) | 7.42 | 7.82 | 7.53 | 7.45 |
| C/(Si + C) | 0.70 | 0.63 | 0.68 | 0.69 |
| H atom density ($\times 10^{22}$ atom/cm$^3$) | 3.33 | 3.35 | 3.38 | 3.51 |
| H/(Si + C + H) | 0.31 | 0.30 | 0.31 | 0.32 |
| $I_D/I_G$ | 0.20 | 0.52 | 0.73 | 0.79 |
| Layer thickness (nm) | 489 | 491 | 490 | 496 |
| Intermediate layer: | | | | |
| Si atom density ($\times 10^{22}$ atom/cm$^3$) | 1.64 | | | |
| C atom density ($\times 10^{22}$ atom/cm$^3$) | 4.21 | | | |
| Si + C atom density ($\times 10^{22}$ atom/cm$^3$) | 5.85 | | | |
| C/(Si + C) | 0.72 | | | |
| H atom density ($\times 10^{22}$ atom/cm$^3$) | 3.74 | | | |
| H/(Si + C + H) | 0.39 | | | |
| Layer thickness (nm) | 489 | 499 | 498 | 496 |
| High-humidity image flow | 1.12 | 1.10 | 1.11 | 1.11 |
| Wear resistance | 0.86 | 0.86 | 0.89 | 1.03 |
| Blurred images | 1.27 | 1.00 | 1.20 | 1.39 |
| Sensitivity | 0.98 | 0.98 | 0.99 | 0.98 |
| Pressure scars | 1.10 | 1.07 | 1.03 | 1.03 |

As shown in Table 45, the intermediate layers 12 of the electrophotographic photosensitive members under the respective "Film forming conditions" are all those formed under the like conditions. Hence, as to the Si atom density, C atom density, Si+C atom density, C/(Si+C), H atom density and H/(Si+C+H) in the intermediate layer 12, the values found from one sample for measuring intermediate layer atom density represent the values of all the electrophotographic photosensitive members.

As the layer thickness of each intermediate layer 12, the value is used which was found by measuring each sample by ellipsometry.

As to the items of the high-humidity image flow, wear resistance, blurred images, sensitivity and pressure scars, the results are shown as those of relative evaluation made on the basis of the value under Film forming conditions No. 102 in Example 7.

As is evident from Table 45, it is seen that setting in the surface layer 11 the $I_D/I_G$ at from 0.20 or more to 0.70 or less brings especially favorable wear resistance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2008-191977, filed Jul. 25, 2008, No. 2008-191983, filed Jul. 25, 2008, and No. 2009-163656, filed Jul. 10, 2009, which are hereby incorporated by reference herein in their entirety.

What is claimed is:

1. A process for forming an electrophotographic image, comprising the steps of:

charging a surface of an electrophotographic photosensitive member, exposing the surface of the electrophotographic photosensitive member to imagewise exposure light, to form an electrostatic latent image on the surface of the electrophotographic photosensitive member, developing the electrostatic latent image with a toner, to form a toner image on the surface of the electrophotographic photosensitive member, transferring the toner image to a transfer material, and fixing the toner image on the transfer material, wherein, the electrophotographic photosensitive member is not heated with a photosensitive member heater throughout the process, wherein, the electrophotographic photosensitive member comprising:

a photoconductive layer, and a surface layer comprising a hydrogenated amorphous silicon carbide, provided on the photoconductive layer, and wherein, a ratio of the number of carbon atoms (C) to a sum of the number of silicon atoms (Si) and the number of carbon atoms (C), C/(Si+C), in the surface layer, is from 0.61 or more to 0.75 or less; and the sum of atom density of the silicon atoms and atom density of the carbon atoms in the surface layer, is $6.60\times10^{22}$ atom/cm$^3$ or more.

2. The process according to claim 1, wherein a ratio of the number of hydrogen atoms (H) to the sum of the number of silicon atoms (Si), the number of carbon atoms (C), and the number of hydrogen atoms (H), H/(Si+C+H), in the surface layer, is from 0.30 or more to 0.45 or less.

3. The process according to claim 1, wherein the sum of atom density of silicon atoms and atom density of carbon atoms in the surface layer, is $6.81\times10^{22}$ atom/cm$^3$ or more.

4. The process according to claim 1, wherein a ratio of peak intensity of 1,390 cm$^{-1}$ ($I_D$) to peak intensity of 1,480 cm$^{-1}$ ($I_G$), $I_D/I_G$, in a Raman spectrum of the surface layer, is from 0.20 or more to 0.70 or less.

5. The process according to claim 1, wherein the photoconductive layer is a layer comprising a hydrogenated amorphous silicon.

6. The process according to claim 1, wherein, the electrophotographic photosensitive member further comprises an intermediate layer provided between the photoconductive layer and the surface layer, a ratio of the number of carbon atoms (C) to the sum of the number of silicon atoms (Si) and number of carbon atoms (C), C/(Si+C), in the intermediate layer, is from 0.61 or more to 0.75 or less, and the sum of atom density of the silicon atoms and atom density of the carbon atoms in the intermediate layer, is from $5.50\times10^{22}$ atom/cm$^3$ or less.

* * * * *